US011685577B2

(12) United States Patent
Meyers et al.

(10) Patent No.: US 11,685,577 B2
(45) Date of Patent: Jun. 27, 2023

(54) DRINKING VESSEL WITH CLOSURE ASSEMBLY

(71) Applicant: Runway Blue, LLC, Alpine, UT (US)

(72) Inventors: David O. Meyers, Layton, UT (US); Jim Allen Colby, Highland, UT (US); John R. Omdahl, II, Lindon, UT (US); Timothy Tyler Bond, Provo, UT (US); Steven M. Sorensen, Alpine, UT (US)

(73) Assignee: Runway Blue, LLC, Alpine, UT (US)

( * ) Notice: Subject to any disclaimer, the term of this patent is extended or adjusted under 35 U.S.C. 154(b) by 0 days.

(21) Appl. No.: 17/540,789

(22) Filed: Dec. 2, 2021

(65) Prior Publication Data

US 2022/0177201 A1 Jun. 9, 2022

Related U.S. Application Data

(60) Provisional application No. 63/121,075, filed on Dec. 3, 2020.

(51) Int. Cl.

| | |
|---|---|
| ***B65D 47/12*** | (2006.01) |
| ***B65D 41/28*** | (2006.01) |
| ***B65D 51/24*** | (2006.01) |

(52) U.S. Cl.

CPC ..... *B65D 47/121* (2013.01); *B65D 47/123* (2013.01); *B65D 41/28* (2013.01); *B65D 51/242* (2013.01); *B65D 2251/0015* (2013.01); *B65D 2251/0087* (2013.01)

(58) Field of Classification Search

USPC ..... 222/478

See application file for complete search history.

(56) References Cited

U.S. PATENT DOCUMENTS

| | | | | |
|---|---|---|---|---|
| 5,232,110 A * | 8/1993 | Purnell | ..... | B65D 47/06 222/481.5 |
| 10,004,348 B2 * | 6/2018 | Sorensen | ..... | B65D 47/0847 |
| 10,172,488 B2 * | 1/2019 | Sorensen | ..... | A47G 19/2272 |

(Continued)

FOREIGN PATENT DOCUMENTS

| | | |
|---|---|---|
| WO | 02/26583 A1 | 4/2002 |
| WO | 2015/109199 A1 | 7/2015 |

OTHER PUBLICATIONS

International Search Report and Written Opinion of the International Searching Authority in International Application No. PCT/US2021/061613, dated Mar. 16, 2022 (16 pages).

*Primary Examiner* — Paul R Durand
*Assistant Examiner* — Michael J. Melaragno
(74) *Attorney, Agent, or Firm* — Sterne, Kessler, Goldstein & Fox P.L.L.C.

(57) ABSTRACT

A drinking vessel including a beverage container and a closure assembly attachable to the beverage container. The beverage container has a spout defining a first drinking opening and a second drinking opening. The closure assembly includes a positioning member and a sealing member. When the positioning member is in a sealing orientation, the positioning member can extend deep enough into the first drinking opening for the sealing member to seal the first drinking opening and the second drinking opening. When the positioning member is not in the sealing orientation, the positioning member cannot extend deep enough into the first drinking opening for the sealing member to seal the first drinking opening and the second drinking opening.

25 Claims, 19 Drawing Sheets

(56) References Cited

U.S. PATENT DOCUMENTS

| | | | | |
|---|---|---|---|---|
| 10,843,850 | B2 * | 11/2020 | Jacobsen | B65D 47/2018 |
| 11,278,139 | B2 * | 3/2022 | Sorensen | A47J 43/27 |
| 2015/0201774 | A1 * | 7/2015 | Sorensen | A47G 19/2266 220/715 |
| 2015/0201775 | A1 * | 7/2015 | Sorensen | B65D 43/26 220/254.1 |
| 2015/0321798 | A1 * | 11/2015 | Isogai | B65D 47/106 215/253 |
| 2018/0099792 | A1 * | 4/2018 | Jacobsen | B65D 47/121 |
| 2020/0039703 | A1 * | 2/2020 | Steinmann | B65D 41/005 |
| 2020/0337484 | A1 * | 10/2020 | Sorensen | B65D 47/0847 |
| 2021/0093110 | A1 * | 4/2021 | Kubota | B01D 29/03 |
| 2022/0177201 | A1 * | 6/2022 | Meyers | B65D 47/123 |

* cited by examiner

DRINKING VESSEL WITH CLOSURE ASSEMBLY

CROSS-REFERENCE TO RELATED APPLICATIONS

This application claims the benefit of U.S. Provisional Patent Application No. 63/121,075, filed Dec. 3, 2020, which is incorporated herein in its entirety by reference thereto.

FIELD

This disclosure generally relates to drinking vessels. More specifically, some embodiments relate to closure assemblies for drinking vessels that can seal multiple drinking openings and/or seal surfaces that are curved or angled, or have another non-planar shape.

BACKGROUND

A drinking vessel may include a spout with a first drinking opening and a second drinking opening. Alternatively or additionally, a drinking vessel may include a spout with an upper surface that is curved or angled, or has another non-planar shape. It may be desirable to seal drinking openings provided in the spout when a user is not drinking from the drinking vessel.

SUMMARY

Some embodiments described herein are directed to a drinking vessel including a beverage container and a closure assembly. The beverage container has a spout, and the spout defines a first drinking opening and a second drinking opening. The closure assembly is attachable to the beverage container. The closure assembly includes a positioning member and a sealing member. When the positioning member is in a sealing orientation, the positioning member can extend deep enough into the first drinking opening for the sealing member to seal the first drinking opening and the second drinking opening. When the positioning member is not in the sealing orientation, the positioning member cannot extend deep enough into the first drinking opening for the sealing member to seal the first drinking opening and the second drinking opening.

Some embodiments described herein are directed to a drinking vessel including a beverage container and a closure assembly. The beverage container has a spout, and the spout defines a first drinking opening and a second drinking opening. The closure assembly is attachable to the beverage container. The closure assembly includes a positioning member, a sealing member, and a cap. When the closure assembly is not in a sealing position, the positioning member, the sealing member, and the cap are rotatable as a unit. When the positioning member is in a sealing orientation, the closure assembly can be lowered into the sealing position. When the closure assembly is in the sealing position, the cap is rotatable relative to the spout while the positioning member and the sealing member remain rotationally stationary relative to the spout. When the closure assembly is in the sealing position, the cap can be attached to the beverage container by rotating the cap so that threads located on the cap engage with threads located on the beverage container. Attaching the cap to the beverage container by engaging the threads located on the cap with the thread located on the beverage container compresses the sealing member between the cap and the spout, thereby sealing the first drinking opening and the second drinking opening.

Some embodiments described herein are directed to a method for sealing a drinking vessel including lowering a closure assembly over a spout of a beverage container, rotating the closure assembly in an engagement direction, when a positioning member of the closure assembly reaches a sealing orientation, further rotating the closure assembly in an engagement direction while the positioning member and an attached sealing member remain in the sealing orientation, and further lowering the closure assembly towards the spout so that threads of the closure assembly can engage with threads of the beverage container. The beverage container has a first drinking opening and a second drinking opening. Lowering the closure assembly lowers a positioning member of the closure assembly into a positioning aperture of the spout. Rotating the closure assembly in the engagement direction causes the positioning member and the attached sealing member to rotate toward a sealing orientation. Engagement of the threads during the further rotating of the closure assembly causes the sealing member to seal the first drinking opening and the second drinking opening. Lowering of the closure assembly towards the spout is prevented by the positioning member when the positioning member is not in the sealing orientation.

BRIEF DESCRIPTION OF THE FIGURES

The accompanying drawings, which are incorporated herein and form a part of the specification, illustrate the present disclosure and, together with the description, further serve to explain the principles thereof and to enable a person skilled in the pertinent art to make and use the same.

DETAILED DESCRIPTION

Figure 1:
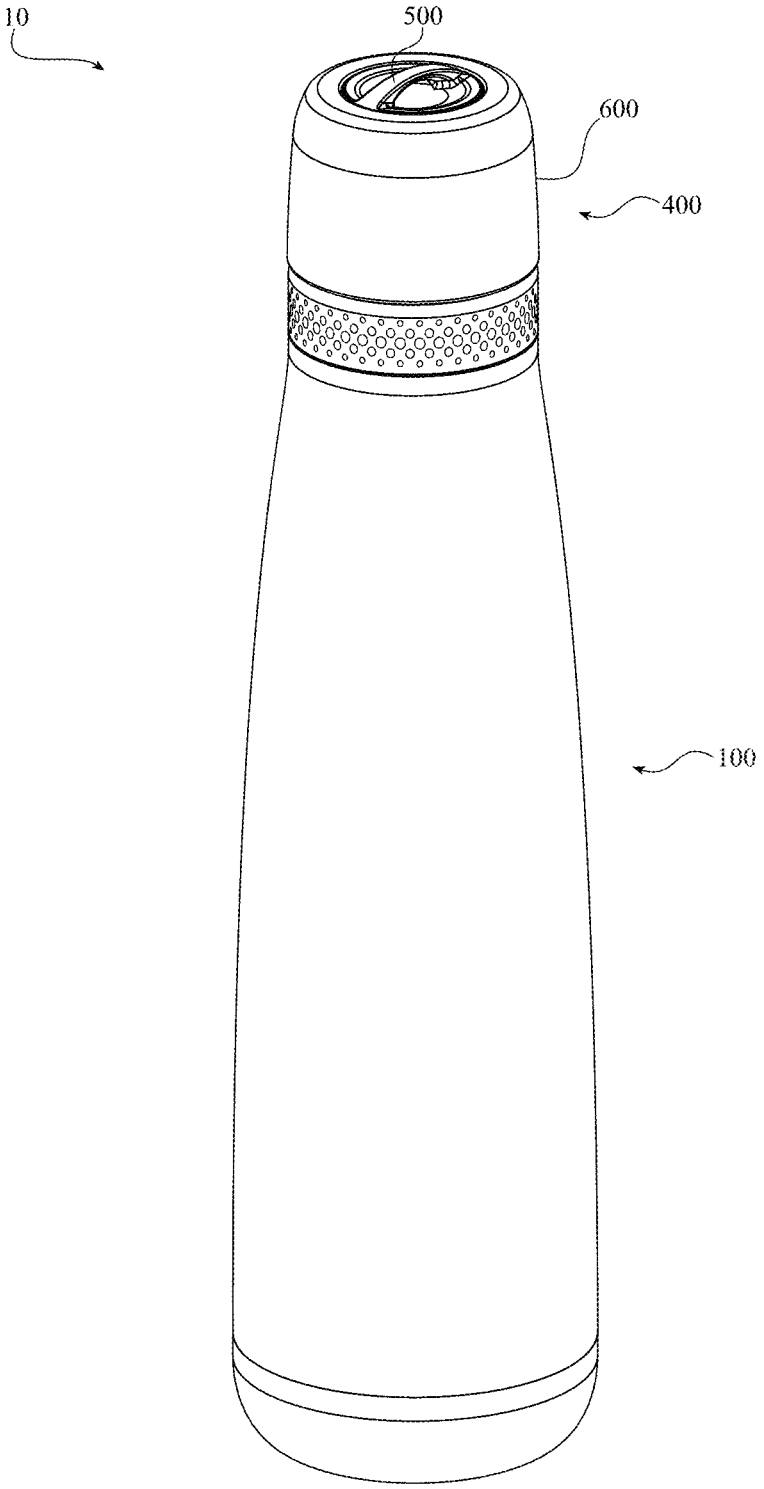
FIG. 1 shows an upper rear perspective view a drinking vessel.

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein comport with standards used by those experienced or skilled in the art to most effectively convey the substance of their work to others skilled in the art. In some instances, well-known methods, procedures, and components have not been described in detail to avoid unnecessarily obscuring aspects of the disclosure.

References in the specification to "some embodiments" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to apply such feature, structure, or characteristic in connection with other embodiments whether or not explicitly described.

The following examples are illustrative, but not limiting, of the present disclosure. Other suitable modifications and adaptations of the variety of conditions and parameters normally encountered in the field, and which would be apparent to those skilled in the art, are within the spirit and scope of the disclosure.

People use reusable drinking vessels to carry a variety of beverages. Some drinking vessels may include a spout having a first drinking opening and a second drinking opening. For example, a spout having a first drinking opening and a second drinking opening may allow a user both to drink a beverage through a straw and to drink a beverage without a straw, using the same spout. For example, a user may tilt a drinking vessel with such a spout in order to pour a beverage through the first drinking opening and into the user's mouth, while a user may suck a beverage up through the second drinking opening and a connected straw while keeping the drinking vessel upright.

It may be desirable for a spout having a first drinking opening and a second drinking opening to have an upper surface that is curved or angled, or has another non-planar shape. For example, positioning the upper surface of the drinking opening that is used to drink from the straw higher than the upper surface of the drinking opening that is used to drink by pouring may allow a user to more easily drink from the drinking vessel. As another example, positioning the upper surface at a front of the drinking opening that is used to drink from the straw higher than the upper surface at a rear of that drinking opening may allow a user to more easily suck the beverage up through that drinking opening.

It may also be desirable for a drinking vessel to include a spout with an upper surface that is curved or angled or has another non-planar shape, even if only a single drinking opening is provided. Such a configuration may, for example, allow a user to more easily drink from the drinking vessel.

It is also often desirable for a drinking vessel to have a closure to seal one or more drinking openings of the drinking vessel when a user is not drinking from it. Sealing the drinking openings can, for example, allow a user to carry the drinking vessel without worrying that the beverage being carried will leak on the user or the user's belongings. Sealing the drinking openings can also, for example, allow the beverage being carried to maintain a desired temperature. However, a spout with multiple drinking openings may be difficult to seal. A spout with an upper surface that is curved or angled, or has another non-planar shape, may also be difficult to seal.

Some embodiments of the present disclosure provide a closure assembly that can be used to seal a beverage container with multiple drinking openings and/or a beverage container that has a spout with an upper surface that is curved or angled, or has another non-planar shape. As will be described in more detail below, the exemplifying closure assembly illustrated herein includes a sealing member, a cap, and a positioning member.

In some embodiments, a sealing surface of the sealing member may have a complex shape that corresponds to a complex shape of the upper surface of the spout. For example, a drinking vessel may include a spout that has an upper surface that curves from a rear portion of the spout up to a front portion of the spout, and a sealing surface of the sealing member may similarly curve from a rear portion of the sealing member up to a front portion of the sealing member. Thus the sealing member may be configured to contact or "mate" with the upper surface of the spout when the sealing member is in a sealing orientation; and the sealing member may not contact or "mate" with the upper surface of the spout when the sealing member is not in the sealing orientation. Accordingly, the sealing member may be capable of sealing the spout when the sealing member is in the sealing orientation and is compressed against the spout. The sealing member may not be capable of sealing the spout, or may not be capable of sealing the spout as effectively, when the sealing member is not in the sealing orientation.

In some embodiments, the cap of the closure assembly may be attachable to the beverage container to compress the sealing member between the cap and the spout. In some embodiments, the cap of the closure assembly may be attachable to the beverage container via a threaded connection.

In embodiments in which the sealing member is not rotationally symmetric (e.g., as described above), the positioning member of the closure assembly may help ensure that the sealing member is in the sealing orientation when the sealing member is compressed against the spout. For example, in embodiments in which the closure assembly is attachable to the beverage container via a threaded connection, the positioning member may help ensure that the sealing member is in the sealing orientation when the sealing member is compressed between the cap and the spout, regardless of the orientation of the cap as it is threaded to the beverage container. In some embodiments, this is achieved by having the sealing member attached to the positioning member, by having the positioning member configured such that it extends fully into the spout in only a single orientation corresponding to the sealing orientation of the sealing member, and by having both the positioning member and the sealing member free to rotate relative to the cap.

With such embodiments, when the positioning member is not in the sealing orientation, the positioning member cannot extend deep enough into the spout for threads on the cap to engage with threads on the beverage container. Accordingly, the sealing member is not compressible between the cap and the spout when the positioning member is not in the sealing orientation. However, a user may rotate the cap, thereby rotating the positioning member and the sealing member toward the sealing orientation. Once the positioning member is in the sealing orientation, the positioning member can extend deep enough into the spout for threads on the cap to engage with threads on the beverage container. As the user rotates the cap to attach the cap to the beverage container, the positioning member may remain in the sealing orientation due to interference between an inner surface of the spout and a portion of the positioning member that extends into the spout. In this way, a user can attach the closure assembly to the spout via the threaded connection without rotating the sealing member away from the sealing orientation. Once the cap is attached to the beverage container, the sealing member is compressed between the cap and the spout, thereby sealing the spout.

In some embodiments, when the closure assembly is attached to the beverage container, the sealing member seals the first drinking opening and the second drinking opening and at least partially defines a fluid pathway between the first drinking opening and the second drinking opening such that the first drinking opening and the second drinking opening are in fluid communication. This may, for example, help reduce the possibility of an undesirable pressure release through one of the drinking openings (e.g., the second drinking opening) when the drinking vessel is opened.

These and other embodiments are discussed below in more detail with reference to the figures.

Figure 2:
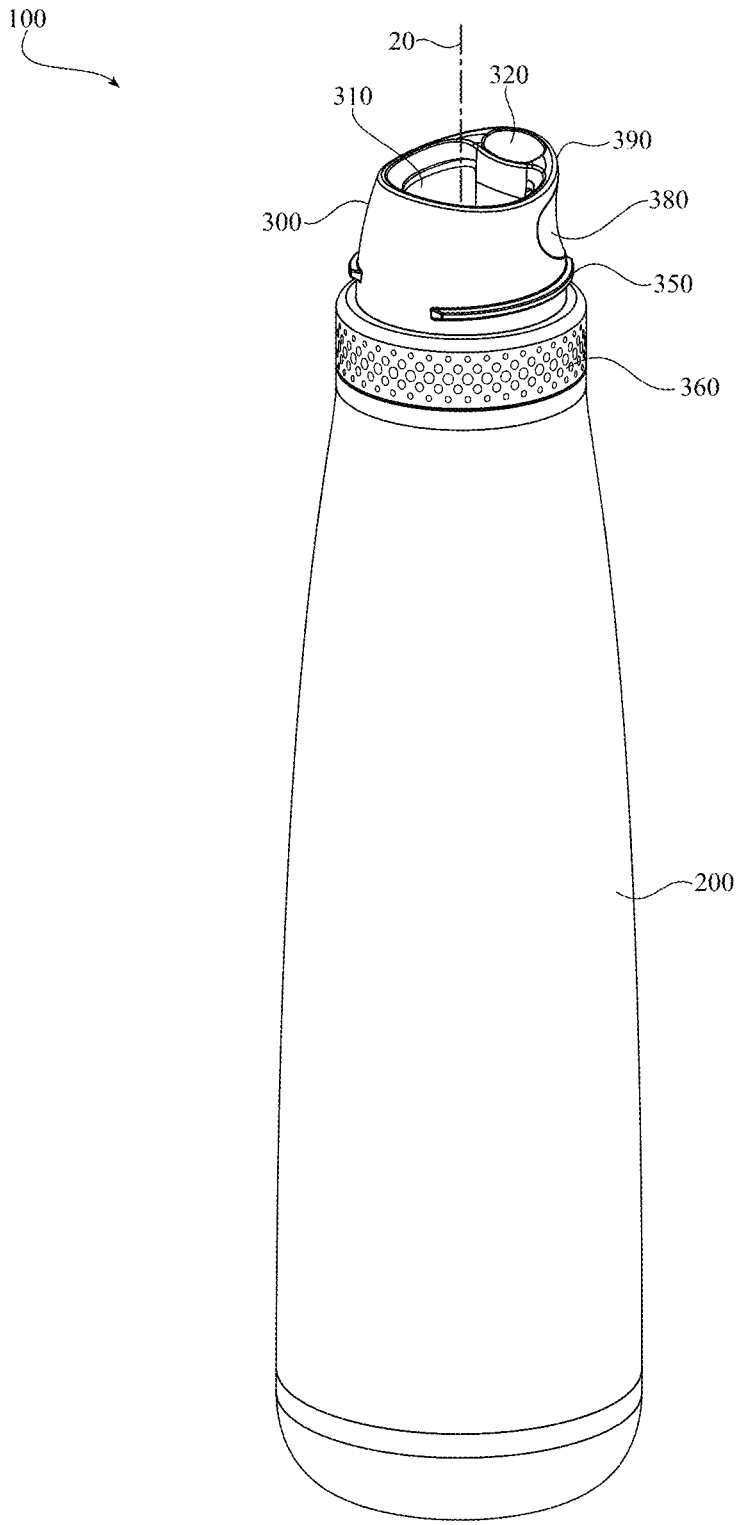
FIG. 2 shows an upper rear perspective view the drinking vessel of FIG. 1 with its closure assembly removed.
Figure 3:
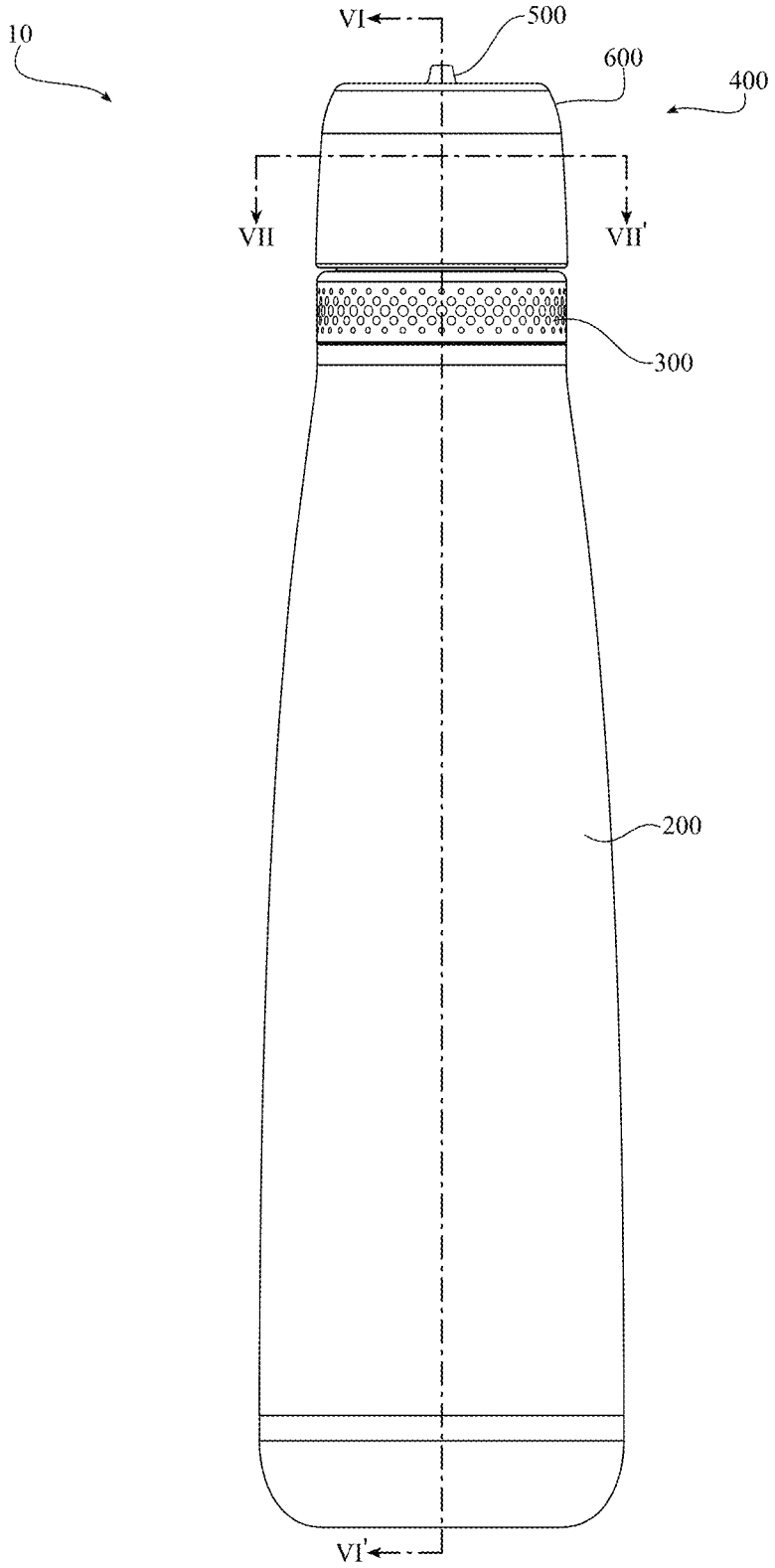
FIG. 3 shows a front view the drinking vessel of FIG. 1.

FIGS. 1-3 show a drinking vessel 10 according to some embodiments. Drinking vessel 10 may include a beverage container 100 and a closure assembly 400 that is attachable to beverage container 100. In FIGS. 1 and 3, drinking vessel 10 is shown with closure assembly 400 attached to beverage container 100. In FIG. 2, drinking vessel 10 is shown with closure assembly 400 removed.

As shown, for example, in FIG. 2, beverage container 100 may include a container body 200 and a spout 300. In some embodiments, spout 300 is formed as a separate component from container body 200. In other embodiments, spout 300 may be formed integrally with container body 200.

Spout 300 may include a first drinking opening 310 and a second drinking opening 320 through which a user may drink a beverage contained within beverage container 100. In some embodiments, an upper surface 390 of spout 300 may have a curved, angled, or other non-planar shape. In some embodiments, first drinking opening 310 may be aligned with a central axis 20 of spout 300 (that is, central axis 20 may extend through opening 310), and second drinking opening 320 may be offset from central axis 20. As mentioned above, it may be difficult to seal a spout with multiple drinking openings (such as spout 300 with first drinking opening 310 and second drinking opening 320). It may also be difficult to seal a spout (such as spout 300) with upper surface 390 that is curved or angled, or has another non-planar shape.

Figure 4A:
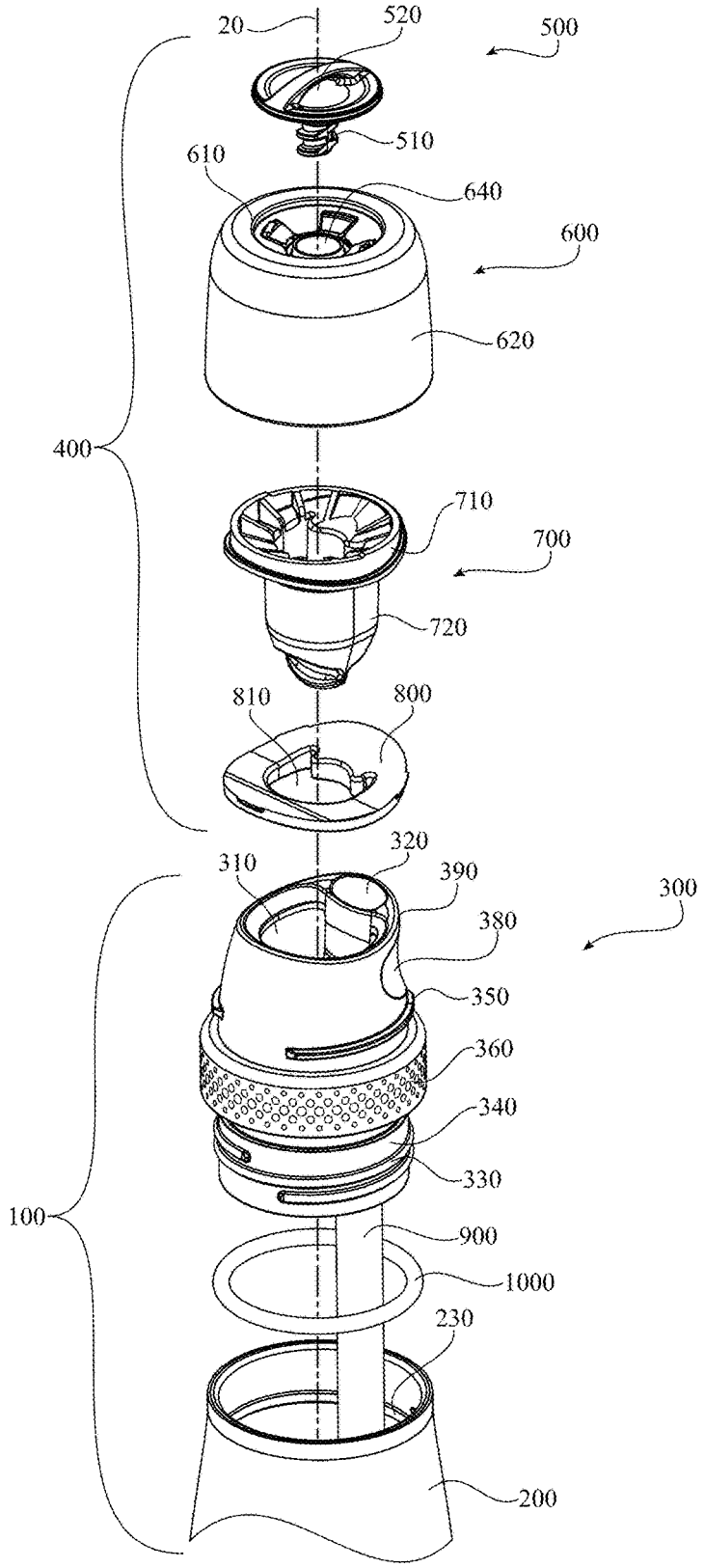
FIG. 4A shows an exploded upper rear perspective view of a portion of the drinking vessel of FIG. 1.
Figure 5A:
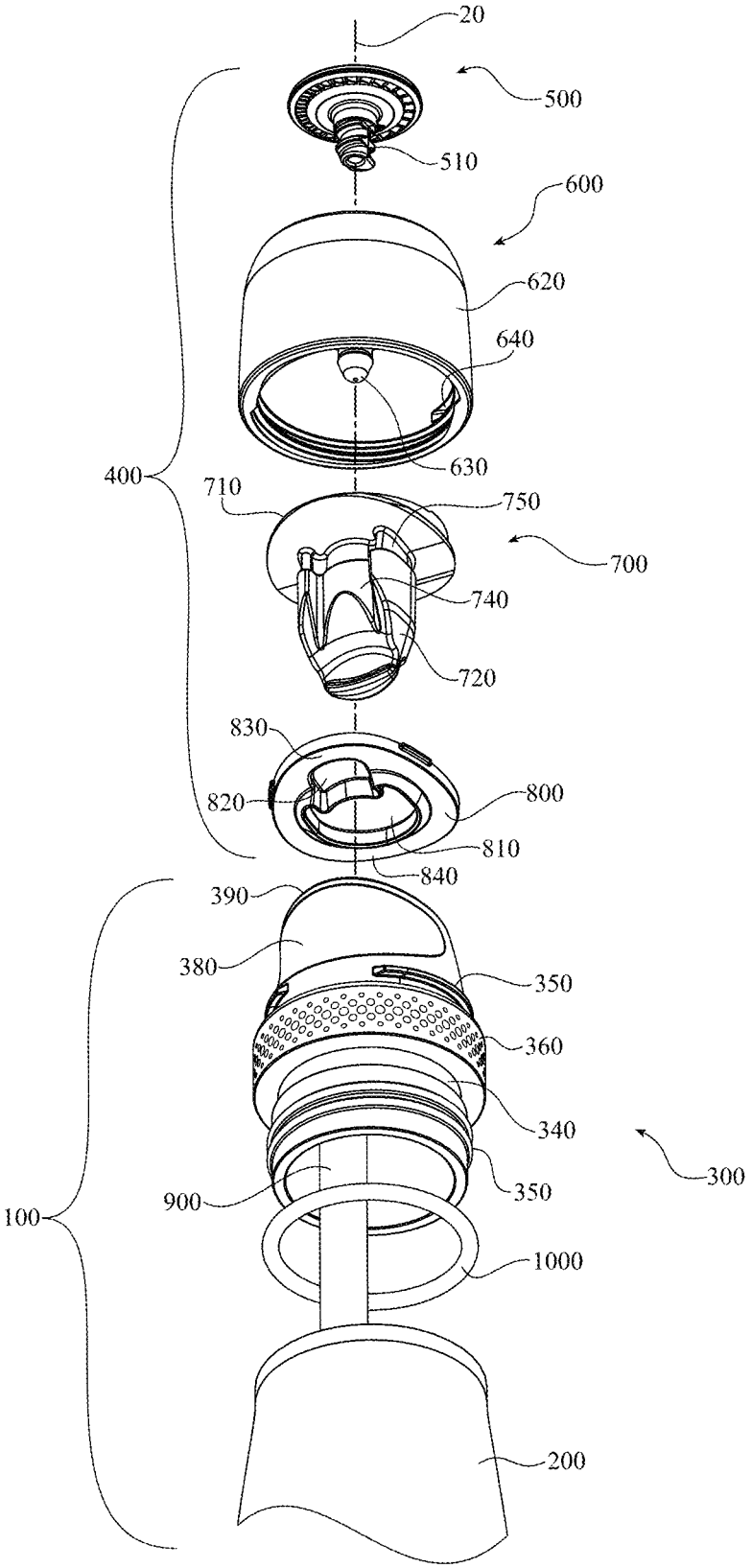
FIG. 5A shows an exploded lower front perspective view of a portion of the drinking vessel of FIG. 1.

FIGS. 4A and 5A show exploded views of drinking vessel 10 according to some embodiments. As shown, drinking vessel 10 includes container body 200, spout 300, and closure assembly 400. Drinking vessel 10 may also include a straw 900. In some embodiments, drinking vessel 10 may include a container sealing member 1000. In such embodiments, when drinking vessel 10 is assembled, container sealing member 1000 may be pressed between container body 200 and spout 300 to create a seal between container body 200 and spout 300. Container sealing member 1000 may be a removable component (e.g., a removable gasket), or may be an integrally-formed part of container body 200 or spout 300. Closure assembly 400 may include multiple components including a carry loop 500, a cap 600, a positioning member 700, and a sealing member 800. In FIGS. 4A and 5A, positioning member 700 and sealing member 800 are shown in the sealing orientation relative to spout 300.

As will be explained in more detail below, in use, sealing member 800 may be positioned around positioning member 700 (e.g., around a protrusion of positioning member 700 beneath a top flange 710 of positioning member 700), such that when positioning member 700 extends into spout 300 in a sealing orientation, sealing member 800 may be pressed against drinking openings 310, 320 of spout 300 to seal drinking openings 310, 320.

Figure 4B:
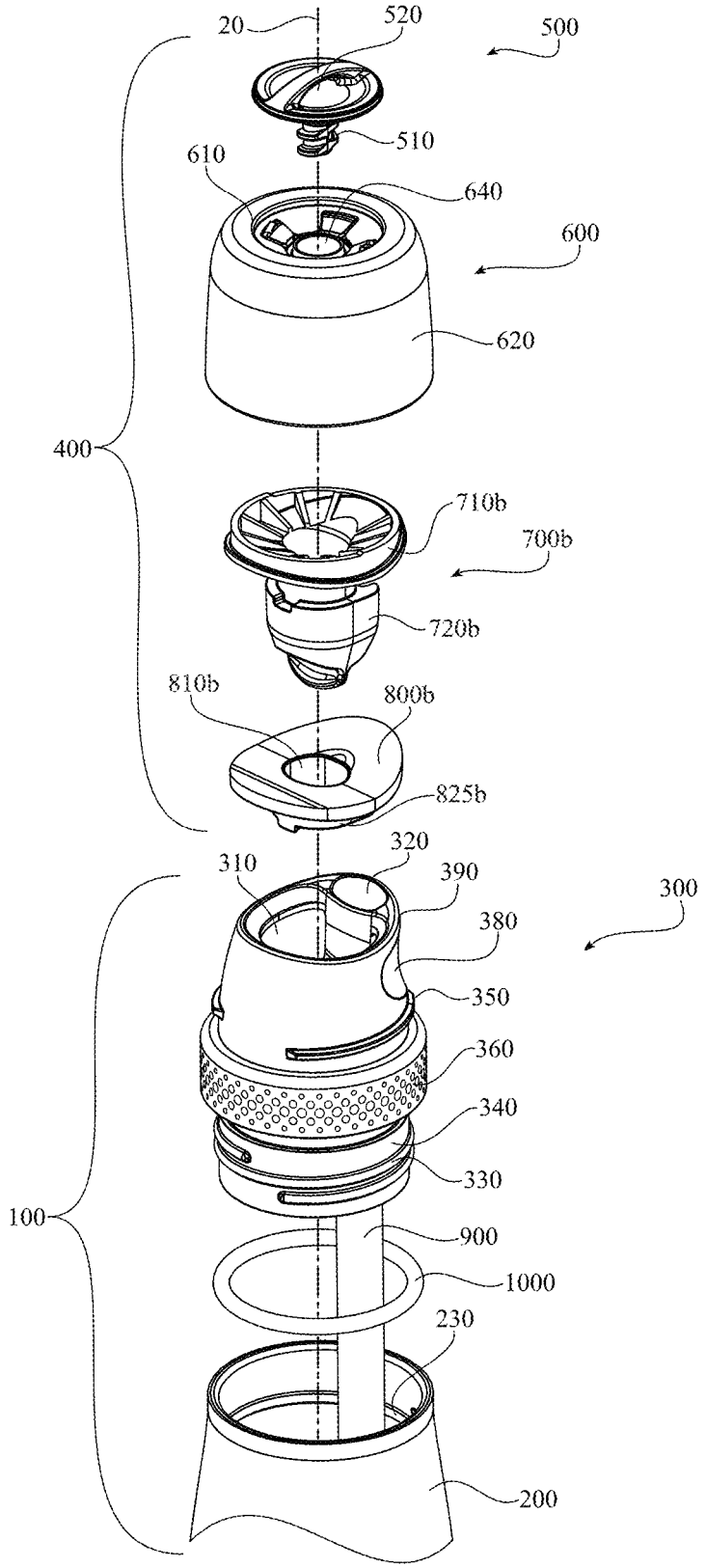
FIG. 4B shows an exploded upper rear perspective view of a portion of the drinking vessel of FIG. 1 with an alternative positioning member and sealing member.
Figure 5B:
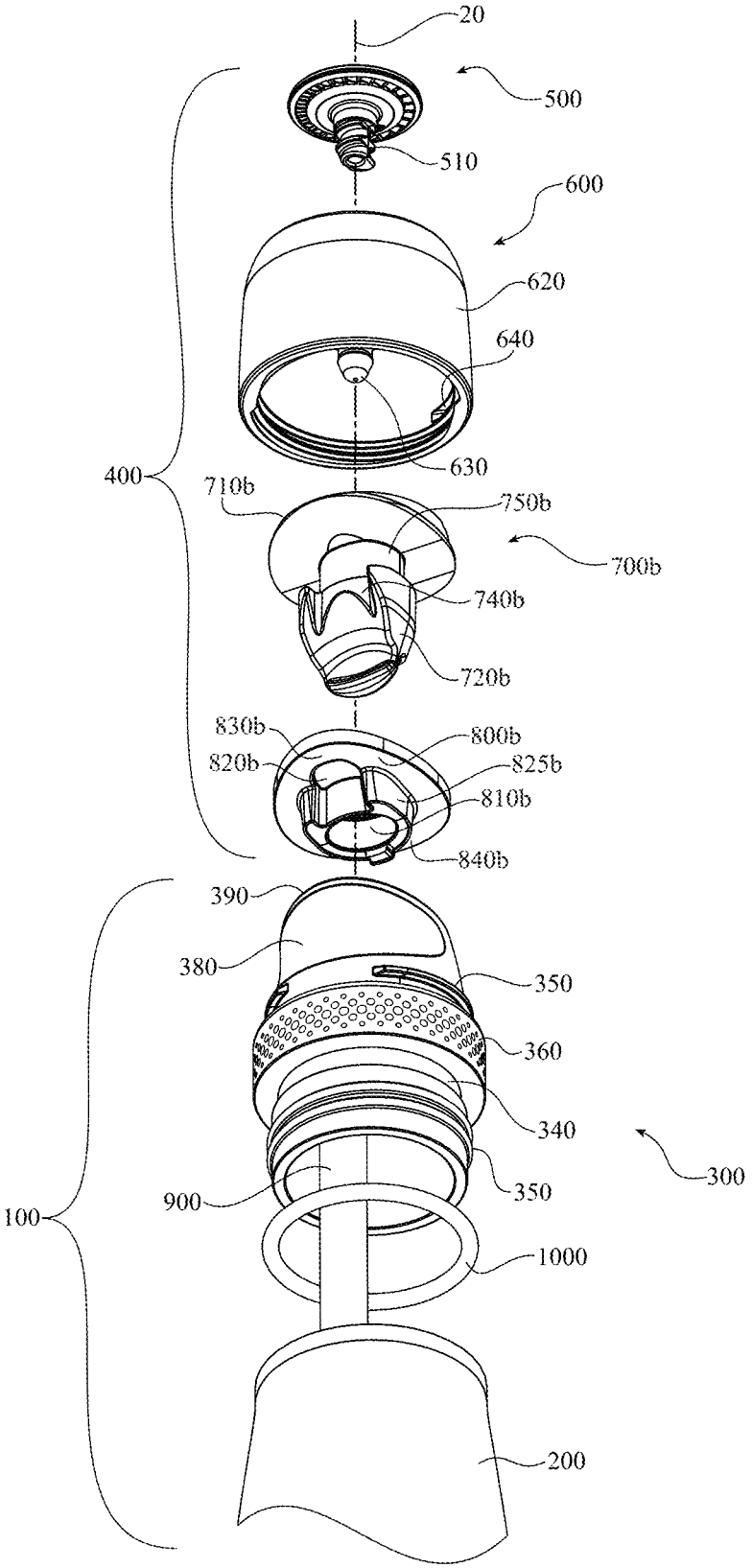
FIG. 5B shows an exploded lower front perspective view of a portion of the drinking vessel of FIG. 1 with an alternative positioning member and sealing member.

FIGS. 4B and 5B show drinking vessel 10 with an alternative positioning member **700*b* and an alternative sealing member 800*b*. Sealing member 800*b* may have a greater height and be positioned within a larger recess of positioning member 700*b*. Positioning member 700*b* can include some or all of the features, structures, or characteristics discussed herein with respect to positioning member 700. Sealing member 800*b* can include some or all of the features, structures, or characteristics discussed above with respect to sealing member 800**.

Figure 4C:
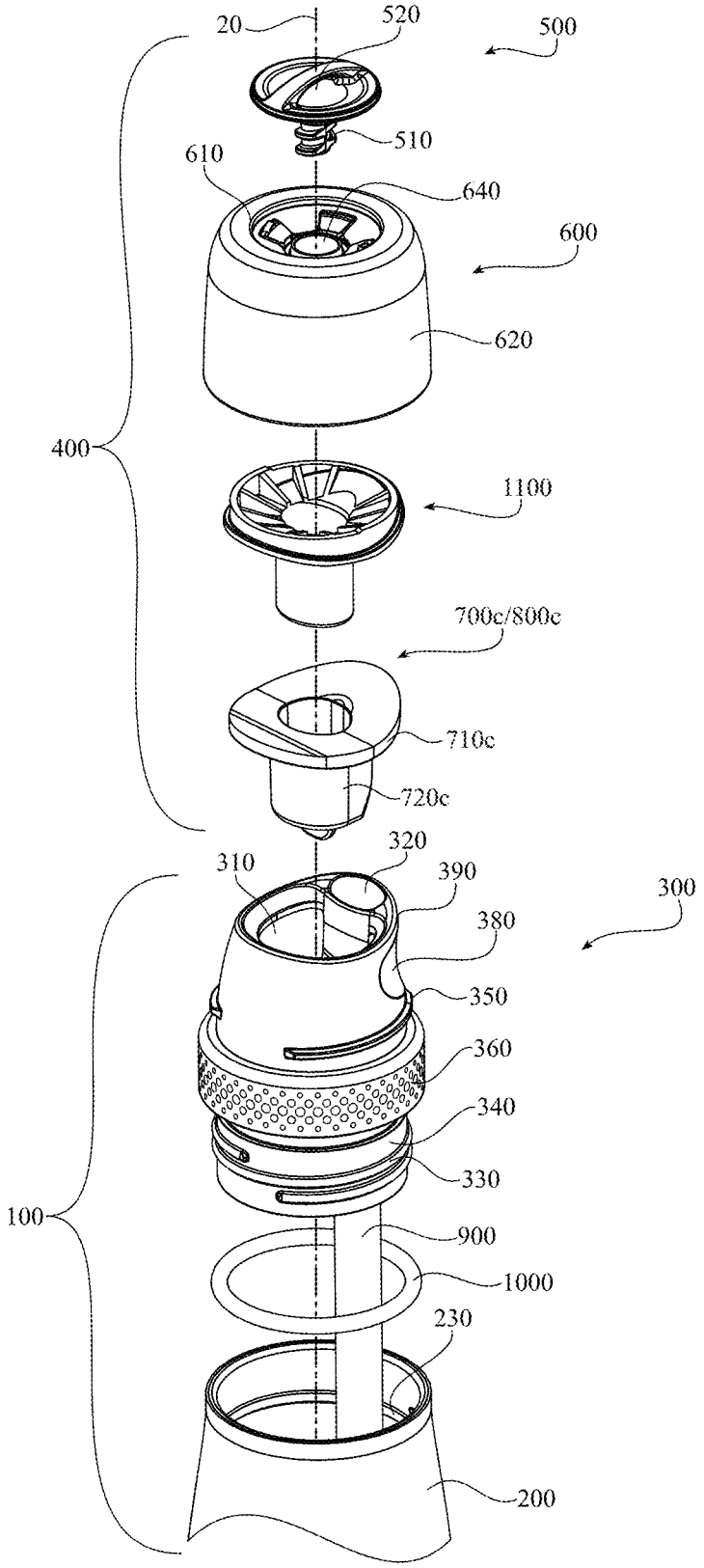
FIG. 4C shows an exploded upper rear perspective view of a portion of the drinking vessel of FIG. 1 with a combined positioning member and sealing member, and with an additional support member.
Figure 5C:
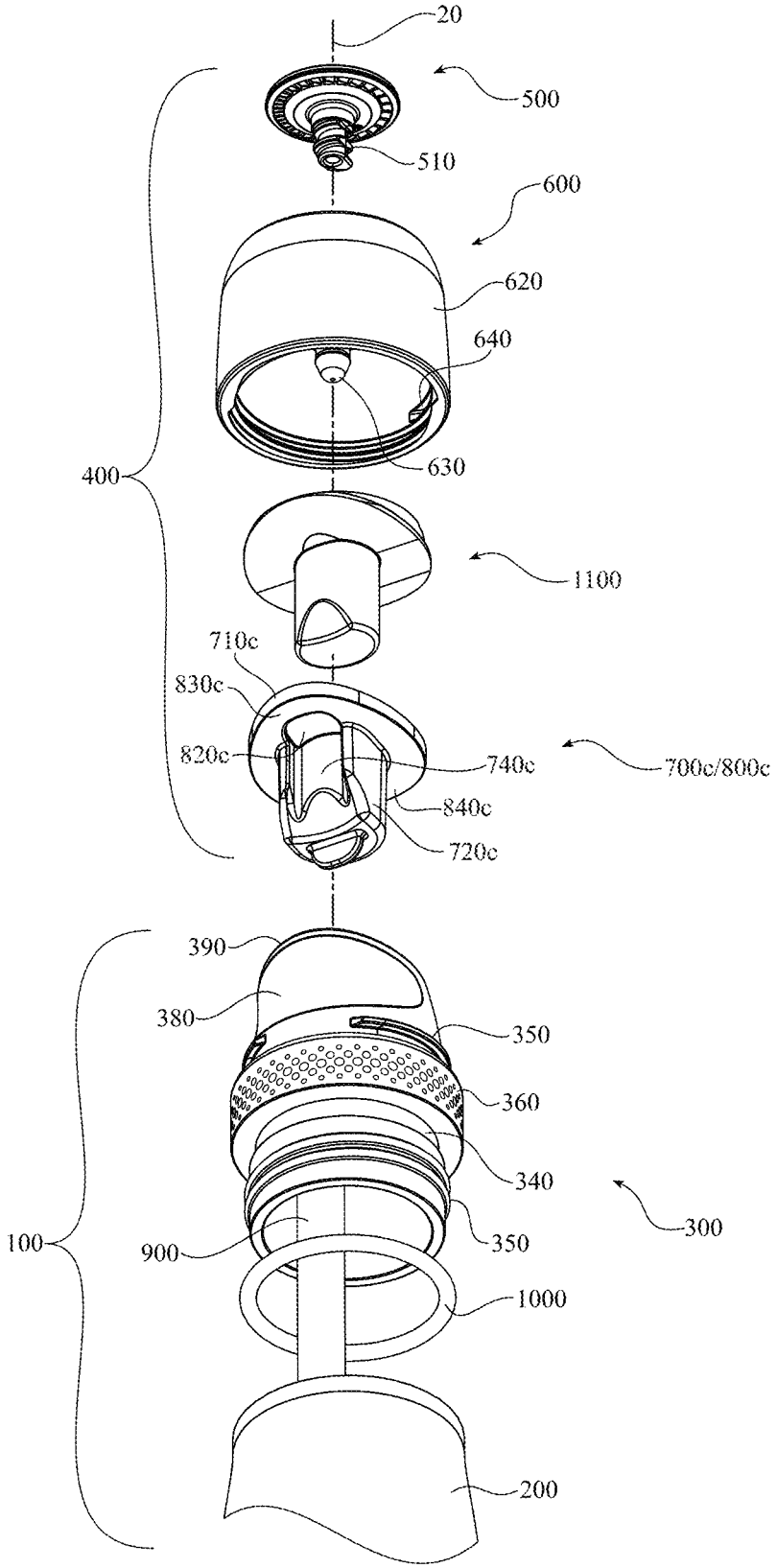
FIG. 5C shows an exploded lower front perspective view of a portion of the drinking vessel of FIG. 1 with a combined positioning member and sealing member, and with an additional support member.

FIGS. 4C and 5C show drinking vessel 10 with a combined positioning member and sealing member **700*c*/800*c*. In this case, rather than the sealing member being a separate component positioned around the positioning member, a single component acts as both the positioning member and the sealing member. Combined positioning member and sealing member 700*c*/800*c* can include some or all of the features, structures, or characteristics discussed herein with respect to positioning member 700 and sealing member 800**.

As mentioned, spout 300 may include first drinking opening 310 and second drinking opening 320. Spout 300 may also include a straw coupling portion 370 (shown, for example, in FIG. 6) in fluid communication with second drinking opening 320. Straw 900 may be attachable to straw coupling portion 370 such that straw 900 is in fluid communication with second drinking opening 320. When straw 900 is attached to straw coupling portion 370, and spout 300 is attached to container body 200, straw 900 may extend into a lower portion of an interior 210 of container body 200.

Accordingly, second drinking opening 320 may be in fluid communication with a lower portion of interior 210 of container body 200. Accordingly, a user may suck a beverage contained within container body 200 up through straw 900 and second drinking opening 320 while keeping drinking vessel 10 upright. Alternatively or additionally, a user may tilt drinking vessel 10 to pour the beverage through first drinking opening 310 and into the user's mouth.

Straw 900 may be attachable to straw coupling portion 370 via a friction fit connection, threaded connection, snap-fit connection, or any other suitable releasable attachment mechanism. In some embodiments, straw 900 may be formed integrally with spout 300.

Straw 900 may be formed of food-grade plastic (e.g., polypropylene, copolyester, the copolymer sold as Eastman Tritan, high-density polyethylene (HDPE), polyoxymethylene (POM), or acrylonitrile butadiene styrene (ABS)), glass, or metal (e.g., steel, stainless steel, aluminum, copper, or titanium).

As shown, for example, in FIG. 4A, in some embodiments, upper surface 390 of spout 300 may have a curved, angled, or other non-planar shape. As a result, a first portion of upper surface 390 of spout 300 may be vertically offset from a second portion of upper surface 390 of spout 300. For example, as shown in FIG. 4A, upper surface 390 of spout 300 at a rear of spout 300 may be positioned lower than upper surface 390 of spout 300 at a front of spout 300. This configuration may, for example, allow a user to more easily pour a beverage from first drinking opening 310 into the user's mouth and/or suck a beverage through straw 900 and second drinking opening 320. As another example, as shown in FIG. 4A, upper surface 390 of spout 300 at a rear of drinking opening 320 may be positioned lower than upper surface 390 of spout 300 at a front of drinking opening 320. This configuration may, for example, allow a user to more easily suck a beverage contained within beverage container 100 through straw 900 and drinking opening 320.

In some embodiments, first drinking opening 310 may be aligned with a central axis 20 of spout 300 (that is, central axis 20 may extend through opening 310), and second drinking opening 320 may be offset from central axis 20. For example, as shown in FIG. 4A, second drinking opening 320 may be positioned at a front of spout 300. This configuration may, for example, allow a user to more easily sip or suck a beverage contained within beverage container 100 through straw 900 and second drinking opening 320.

As mentioned, closure assembly 400 may include sealing member 800 to seal first drinking opening 310 and second drinking opening 320. Sealing member 800 may have any shape sufficient to seal first drinking opening 310 and second drinking opening 320 when sealing member 800 is in the sealing orientation and compressed against spout 300. The term seal as used here and elsewhere in this document does not necessarily require a perfect hermetic seal; rather a seal capable of inhibiting passage of liquid fluid is sufficient.

In some embodiments, sealing member 800 has a shape that corresponds to the shape of upper surface 390 of spout 300 when sealing member 800 is in the sealing orientation. For example, as shown in FIGS. 4A and 5A, upper surface 390 of spout 300 at a rear of spout 300 may be positioned lower than upper surface 390 of spout 300 at a front of spout 300; sealing member 800 may be similarly shaped such that when sealing member 800 is in the sealing orientation, a first sealing portion 830 of sealing member 800 located above the front of spout 300 is positioned higher than a second sealing portion 840 of sealing member 800 located above the rear of spout 300. In some embodiments, sealing member 800 has a shape that corresponds to at least a portion of upper surface 390 surrounding both first opening 310 and second opening 320 such that sealing member 800 can seal both first opening 310 and second opening 320 together.

Sealing member 800 may be formed of a food-grade material suitable to create a seal around first drinking opening 310 or second drinking opening 320.

As mentioned, closure assembly 400 may include cap 600 to attach closure assembly 400 to beverage container 100. Attaching cap 600 to beverage container 100 may, for example, compress sealing member 800 between spout 300 and cap 600 in order to seal spout 300.

Cap 600 may include a top surface 610 and side walls 620. When closure assembly 400 is attached to spout 300, side walls 620 of cap 600 may at least partially enclose spout 300 such that side walls 620 inhibit dirt or debris from contacting upper surface 390 of spout 300 which a user is likely to contact when drinking from drinking vessel 10.

In some embodiments, cap 600 may include an attachment mechanism 640 (shown, for example, on cap 600 in FIG. 5A), and spout 300 may include a corresponding attachment mechanism 350 on an upper portion of spout 300. Attachment mechanism 640 may be configured to engage with attachment mechanism 350 to removably attach cap 600 to spout 300. In some embodiments, for example, as shown in FIG. 5A, attachment mechanisms 350 and 640 may be or include threads 350 (located, for example, on an external surface of spout 300) and threads 640 (located, for example on an internal surface of cap 600). However, attachment mechanisms 350 and 640 may be friction fit connectors, snap-fit connectors, or any other suitable releasable attachment mechanism. The attachment of closure assembly 600 to spout 300 is not limited to the arrangement shown in the figures. For example, in some embodiments, closure assembly 400 may attach inside spout 300 rather than outside spout 300.

As mentioned, closure assembly 400 may include positioning member 700 to help ensure that sealing member 800 is in the sealing orientation when sealing member 800 is compressed between cap 600 and spout 300. For example, in embodiments in which cap 600 is attachable to spout 300 via a threaded connection, positioning member 700 may help ensure that sealing member 800 is in the sealing orientation when sealing member 800 is compressed between cap 600 and the spout 300, regardless of the orientation of cap 600 as it is threaded to spout 300.

As shown in FIGS. 4A and 5A, for example, positioning member 700 may be a separate component from sealing member 800. However, in some embodiments, sealing member 800 may be integrally formed as part of positioning member 700. For example, in FIGS. 4C and 5C, sealing member 800*c* and positioning member 700*c* are formed as a unitary component. In some embodiments, for example as shown in FIGS. 4C and 5C, sealing member 800*c* and/or positioning member 700*c* may be supported by supporting member 1100.

In some embodiments, sealing member 800 may be fixed in position relative to positioning member 700 such that rotation of positioning member 700 also rotates sealing member 800. In FIGS. 4A and 5A, for example, sealing member 800 includes a receiving opening 810 that can receive protrusion 720 of positioning member 700. Receiving opening 810 and protrusion 720 may be shaped such that sealing member 800 cannot rotate relative to protrusion 720 when sealing member 800 is positioned on protrusion 720. In FIGS. 4C and 5C, for example, rotating positioning member 700*c* also rotates sealing member 800*c* because positioning member 700*c* and sealing member 800*c* are combined as a single component.

In some embodiments, for example as shown in FIGS. 4A and 5A, a portion of sealing member 800 may be received in a recess 750 of positioning member 700 to further hold positioning member 700 in place. The size and position of recess 750 is not limited to the size and position of recess 750 shown in FIGS. 4A and 5A. For example, as shown in FIGS. 4B and 5B, recess 750*c* may be larger than recess 750 of FIG. 5A so that more of sealing member 800*b* is positioned within recess 750*b*. In this case, portions of a protrusion 825*b* of sealing member 800*b* may correspond to the shape of protrusion 720*b* of positioning member 700*b*, so that sealing member 800*b* can act as a continuation of positioning member 700*b* when closure assembly 400 is nearing a sealed position relative to spout 300.

Figure 6:
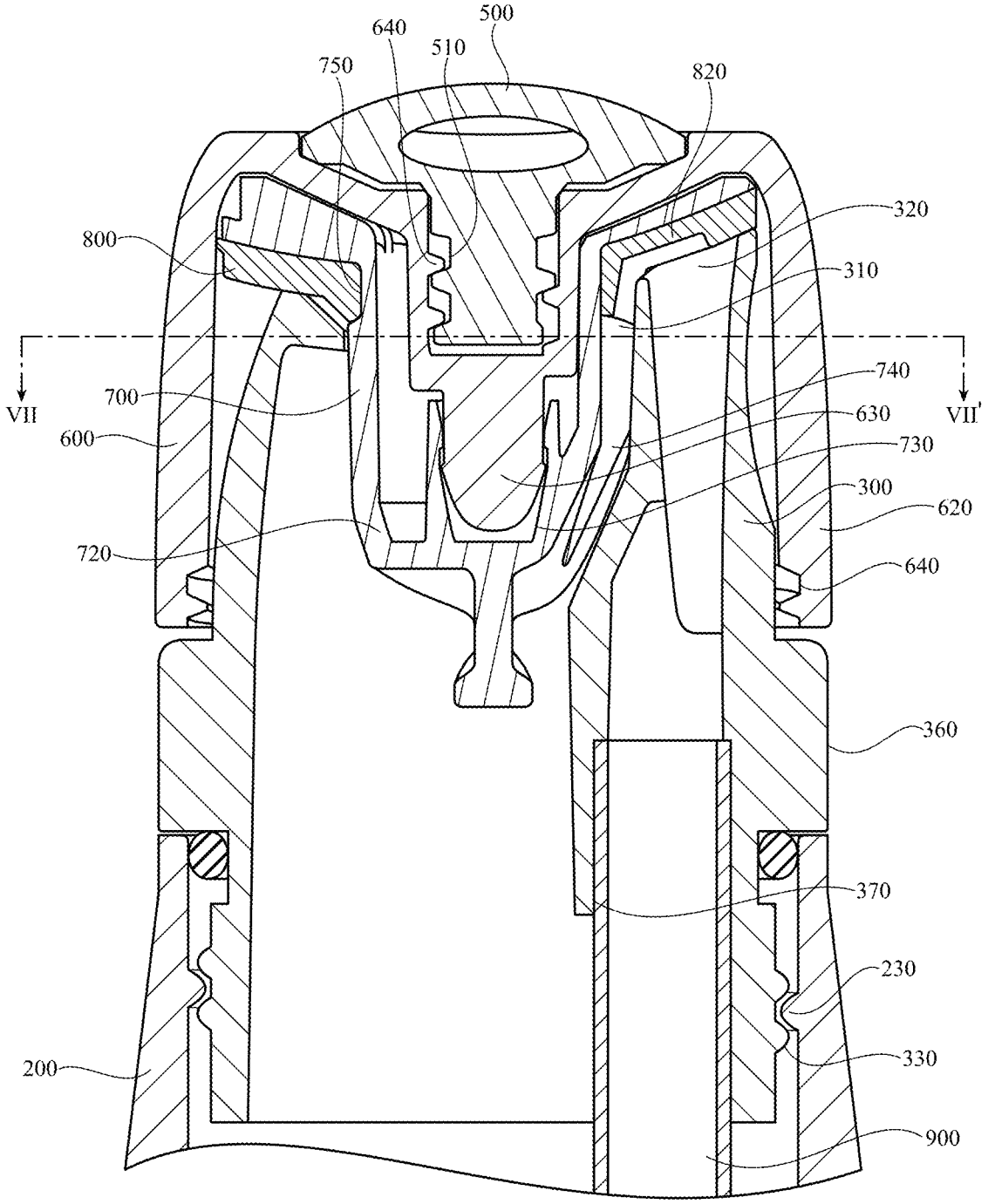
FIG. 6 shows a cross-sectional view of a portion of the drinking vessel of FIG. 1, taken along line VI-VI' of FIG. 3.

As shown, for example in FIG. 6, positioning member 700 may be coupled to cap 600 through a snap-fit connection in which stud 630 of cap 600 engages with socket 730 of positioning member 700. However, positioning member 700 can be coupled to cap 600 through any suitable attachment mechanism that allows rotation of positioning member 700 relative to cap 600.

In some embodiments, when closure assembly 400 is assembled, a portion of positioning member 700 may be positioned inside cap 600 such that side walls 620 of cap 600 extend around positioning member 700.

In some embodiments, both sealing member 800 and positioning member 700 are free to rotate relative to cap 600. For example, as shown in FIG. 6, the snap-fit connection between stud 630 of cap 600 and socket 730 of positioning member 700 securely couples positioning member 700 to cap 600 (because stud 630 is held in socket 730) but still allows positioning member 700 to rotate relative to cap 600 (because stud 630 can rotate within socket 730). For example, positioning member 700 may rotate about central axis 20 extending through stud 630 and socket 730. When closure assembly 400 is assembled, an outer perimeter of positioning member 700 may be spaced away from an inner surface of cap 600 to facilitate rotation of positioning member 700 relative to cap 600. An outer perimeter of sealing member 800 may be spaced away from an inner surface of cap 600 to facilitate rotation of positioning member 700 and sealing member 800 relative to cap 600.

Figure 7:
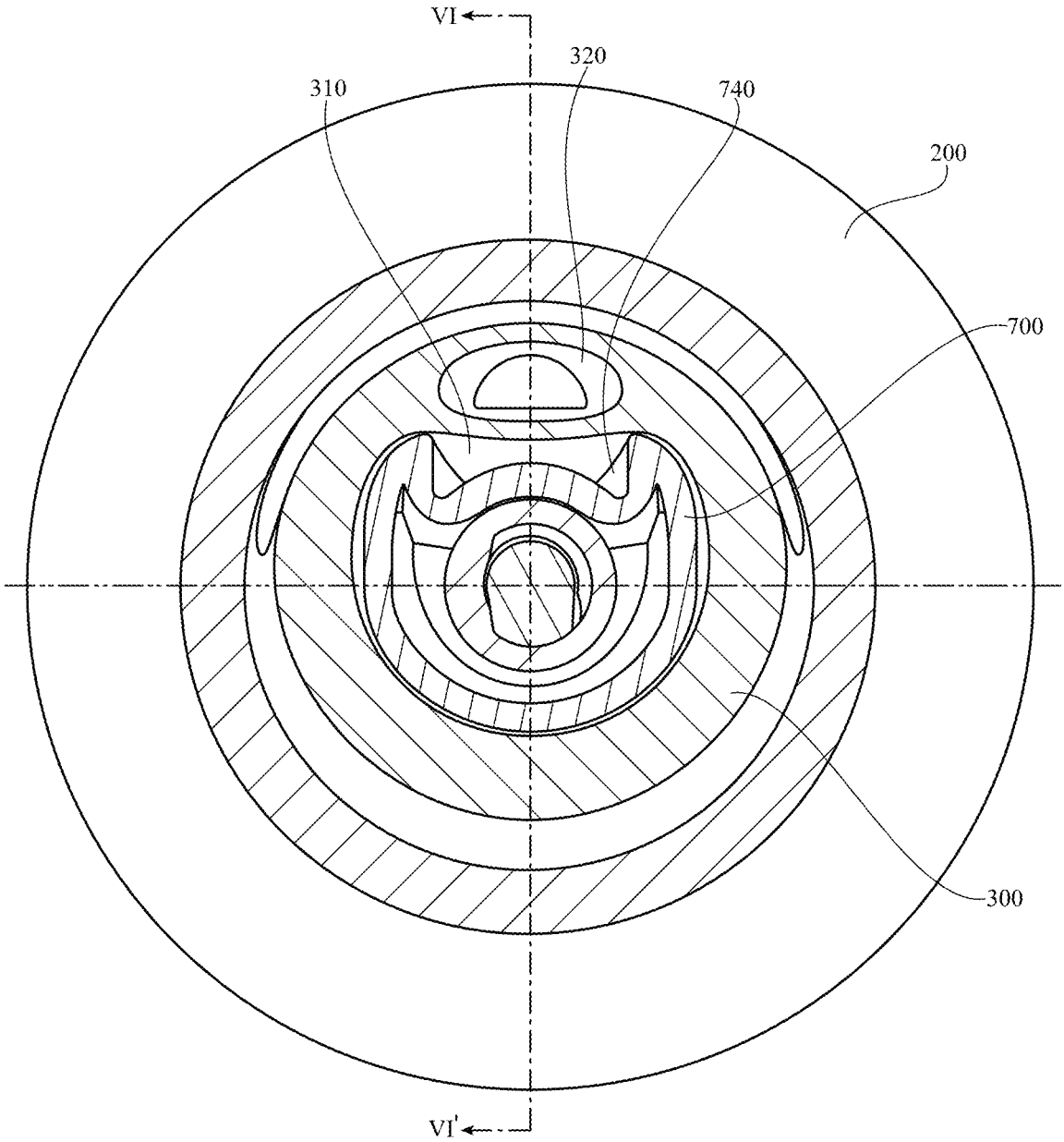
FIG. 7 shows a cross-sectional view of the drinking vessel of FIG. 1, taken along line VII-VII' of FIG. 3.
Figure 10:
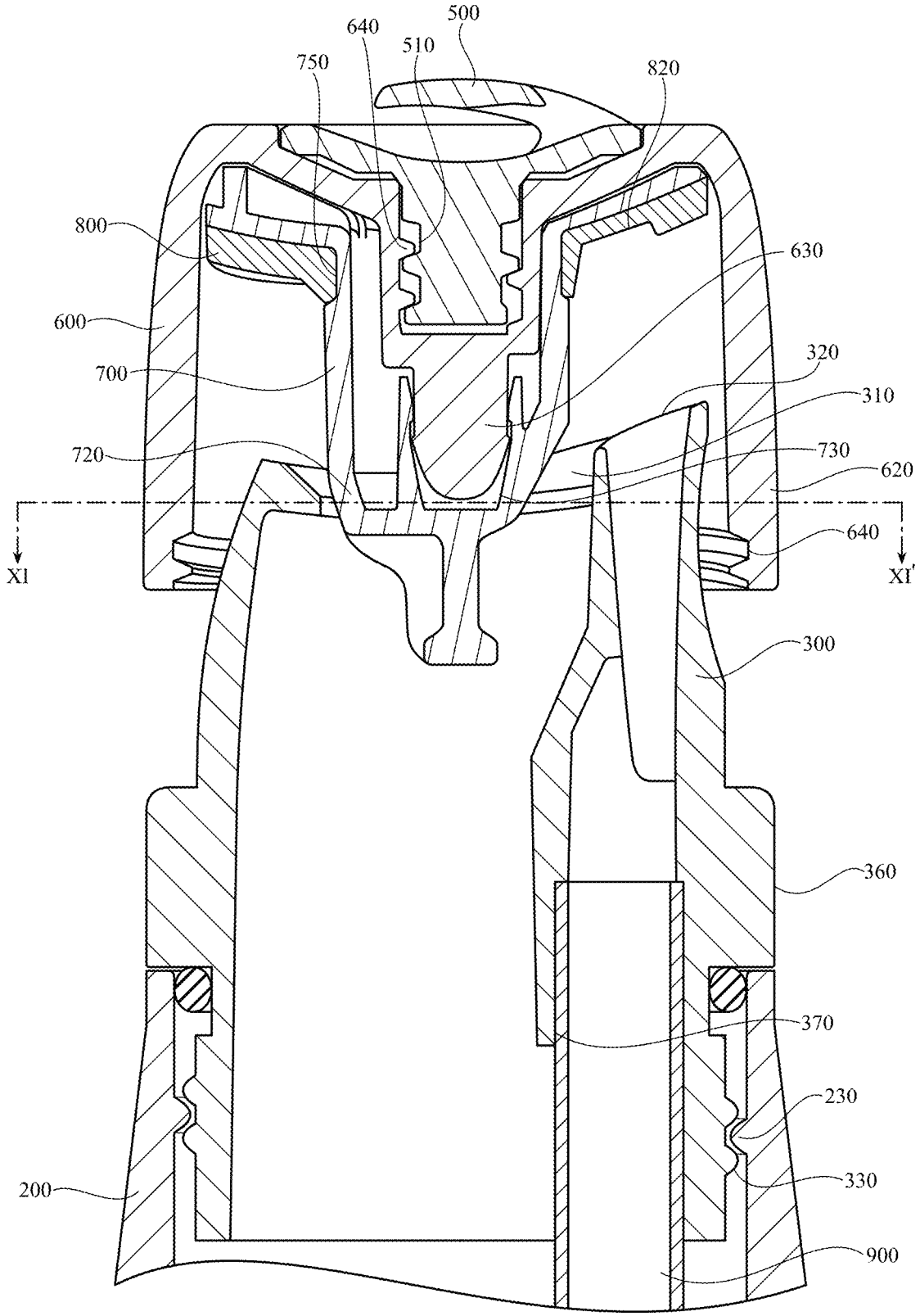
FIG. 10 shows a cross-sectional view of a portion of the drinking vessel of FIG. 1, with its closure assembly in a second position relative to its spout during a closing operation, taken along line X-X' of FIG. 11.
Figure 11:
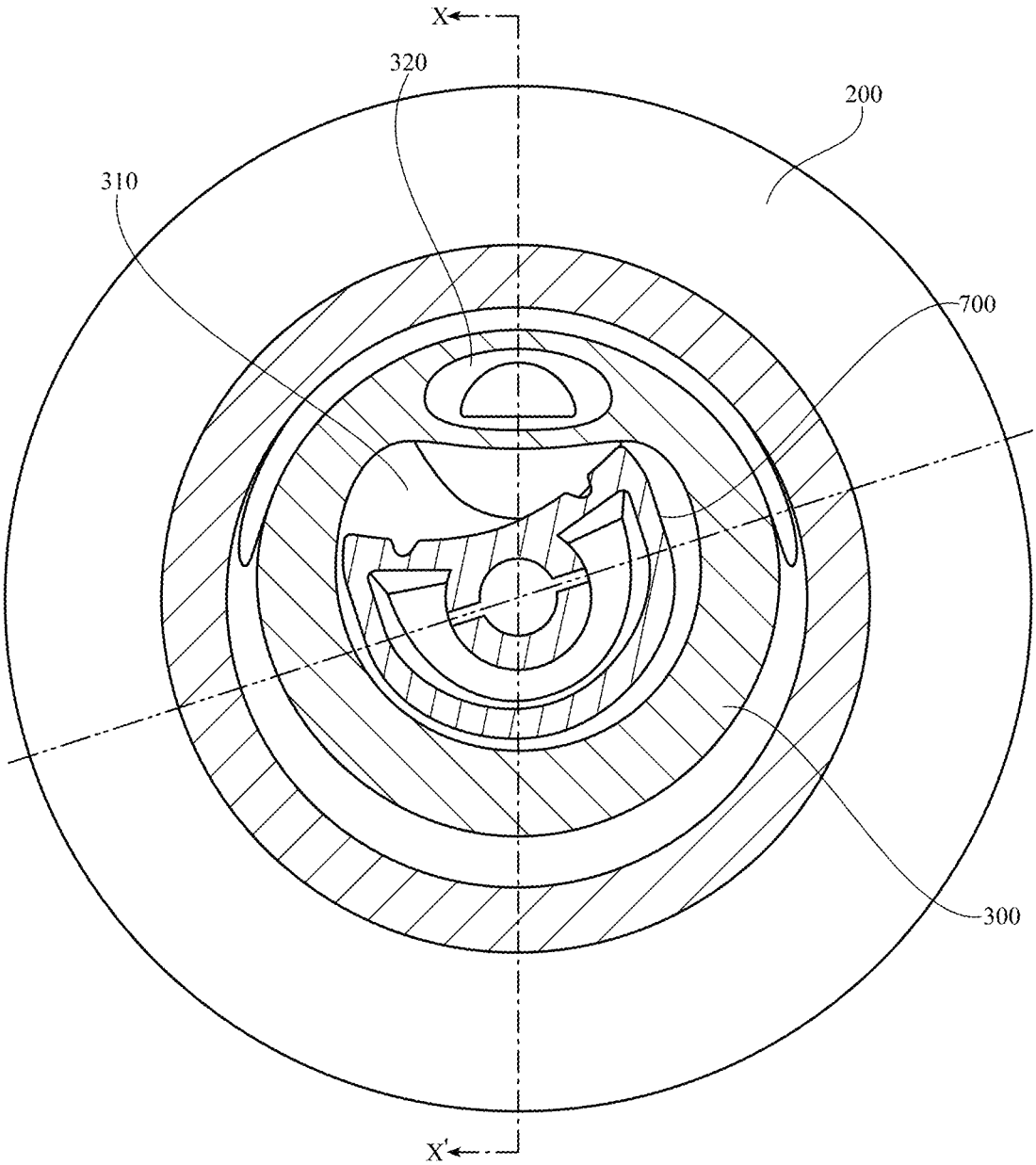
FIG. 11 shows a cross-sectional view of the drinking vessel of FIG. 1, with its closure assembly in a second position relative to its spout during a closing operation, taken along line XI-XI' of FIG. 10.

Positioning member 700 may include a protrusion 720 that extends down from a top flange 710 of positioning member 700. Protrusion 720 may be configured such that protrusion 720 can extend down fully into first drinking opening 310 of spout 300 when positioning member 700 is in the sealing orientation relative to spout 300 (e.g., as shown in FIGS. 6-7), and so that protrusion 720 cannot extend down fully into first drinking opening 310 of spout 300 when positioning member 700 is in not in the sealing orientation (e.g., as shown in FIGS. 10-11).

When closure assembly 400 is not in the sealing position (i.e., when positioning member 700 is not in the sealing orientation with protrusion 720 extended fully into first drinking opening 310), positioning member 700, sealing member 800, and cap 600 may rotate as a unit. In this way, a user may rotate protrusion 720 toward the sealing orientation by rotating cap 600 (e.g., in an engagement direction). When positioning member 700 is in the sealing orientation (e.g., as shown in FIGS. 6-7), protrusion 720 can be extended down fully into first drinking opening 310 of spout 300. When the closure assembly is in the sealing position (i.e., when positioning member 700 is in the sealing orientation with protrusion 720 extended fully into first drinking opening 310), cap 600 may be rotatable relative to spout 300 while positioning member 700 and sealing member 800 remain rotationally stationary relative to spout 300. For example, interference between the inner surface of first drinking opening 310 and protrusion 720 may cause protrusion 720 to remain in the sealing orientation while a user rotates cap 600.

When the closure assembly is in the sealing position, cap 600 may be sufficiently low over spout 300 such that threads 640 located on cap 600 may be able to engage with threads 350 located on spout 300. As a result, when closure assembly 400 is in the sealing position, a user may be able to attach cap 600 to spout 300 via a threaded connection without rotating protrusion 720 away from the sealing orientation. In turn, attaching cap 600 to beverage container 100 may compress sealing member 800 between cap 600 and spout 300, thereby sealing first drinking opening 310 and second drinking opening 320.

To facilitate this operation, a cross sectional shape of protrusion 720 may correspond to a cross sectional shape of first drinking opening 310. For example, in some embodiments, a cross section of first drinking opening 310 may not be rotationally symmetric about central axis 20. In such an embodiment, a cross section of protrusion 720 may also not be rotationally symmetric about central axis 20. Such a configuration may contribute to protrusion 720 being fully extendable into first drinking opening 310 when positioning member 700 is in a sealing orientation but not when positioning member 300 is in another orientation. As a result, such a configuration may also help guide positioning member 700 to the sealing orientation or keep positioning member 700 is the sealing orientation.

As another example, in some embodiments, a cross section of first drinking opening 310 may have a length (e.g., measured in a left-right direction) and a width (e.g., measured in a front-back direction). The length of the cross section of first drinking opening 310 may be greater than the width of the cross section of first drinking opening 310. In such an embodiment, a cross section of protrusion 720 may have a length (e.g., measured in a left-right direction when positioning member 700 is in the sealing orientation) and a width (e.g., measured in a front-back direction when positioning member 700 is in the sealing orientation). The length of the cross section of protrusion 720 may similarly be greater than the width of the cross section of protrusion 720. Such a configuration may contribute to protrusion 720 being fully extendable into first drinking opening 310 when positioning member 300 is in a sealing orientation but not when positioning member is in another orientation. As a result, such a configuration may help guide positioning member 700 to the sealing orientation or keep positioning member 700 is the sealing orientation.

In some embodiments, protrusion 720 may be tapered such that a lower portion of protrusion 720 has a smaller cross sectional area than an upper portion of protrusion 720 does. Such a configuration may allow protrusion 720 to begin to extend into first opening 310 when a user first places closure 400 over spout 300, regardless of whether positioning member 700 is initially in the sealing orientation. Then, the user may rotate cap 600 in an engagement direction, thereby rotating positioning member 700 toward the sealing orientation. The taper of protrusion 720 allows protrusion 720 to extend further into first drinking opening 310 as positioning member 700 approaches the sealing orientation. Thus, such a configuration may allow a user to simultaneously rotate positioning member 700 to the sealing orientation and lower protrusion 720 into first drinking opening 310.

In some embodiments, protrusion 720 may be more oblong at a lower portion of protrusion 720 than at an upper portion of protrusion 720. That is, protrusion 720 may have a length-to-width ratio in a first horizontal plane, and a second length-to-width ratio in a second horizontal plane located above the first horizontal place. The first length-to-width ratio may be greater than the second length-to-width ratio. Such a configuration may allow protrusion 720 to begin to extend into first opening 310 when a user first places closure 400 over spout 300, regardless of whether positioning member 700 is initially in the sealing orientation. Then, the user may rotate cap 600 in an engagement direction, thereby rotating positioning member 700 toward the sealing orientation. The changing cross sectional shape of protrusion 720 allows protrusion 720 to extend further into first drinking opening 310 as positioning member 700 approaches the sealing orientation. Thus, such a configuration may allow a user to simultaneously rotate positioning member 700 to the sealing orientation and lower protrusion 720 into first drinking opening 310.

In some embodiments, for example as shown in FIG. 5A, protrusion 720 may define a channel 740. Channel 740 may least partially define a fluid pathway between first drinking opening 310 and the second drinking opening 320 when closure assembly 400 is attached to beverage container 100. This may, for example, help reduce the possibility of an undesirable pressure release through one of the drinking openings (e.g., second drinking opening 320) when drinking vessel 10 is opened. In some embodiments, for example as shown in FIG. 5A, sealing member 800 may define a channel 820. Channel 820 may least partially define a fluid pathway between first drinking opening 310 and the second drinking opening 320 when closure assembly 400 is attached to beverage container 100. This may also, for example, help reduce the possibility of an undesirable pressure release through one of the drinking openings (e.g., the second drinking opening 320) when the drinking vessel is opened.

Positioning member 700 may be formed of food-grade plastic (e.g., polypropylene, copolyester, the copolymer sold as Eastman Tritan, high-density polyethylene (HDPE), polyoxymethylene (POM), or acrylonitrile butadiene styrene (ABS)), glass, or metal (e.g., steel, stainless steel, aluminum, copper, or titanium).

When closure assembly 400 is assembled, carry loop 500 may be coupled to cap 600. In some embodiments, carry loop 500 may be a separate component from cap 600. In some embodiments, carry loop 500 may be integrally formed as part of cap 600.

In embodiments in which carry loop 500 is a separate component from cap 600, carry loop 500 may be attachable to cap 600. For example, carry loop 500 may include an attachment mechanism 510 on a lower portion of carry loop 500, and cap 600 may include a corresponding attachment mechanism 640. Attachment mechanism 510 may be configured to engage with attachment mechanism 640 to removably attach carry loop 500 to cap 600. Attachment mechanisms 510 and 640 may be threaded connectors (as shown in FIG. 4A), friction fit connectors, snap-fit connectors, or any other suitable releasable attachment mechanism.

Carry loop 500 may define an opening 520 through which a length of cord, cable, rope, chain, or other material may be threaded or around which a cord, cable, rope, chain, or other material may be tied (e.g., using a cow's hitch knot or other type of knot). The cord, cable, rope, chain, or other material connected to or around opening 520 may create a loop or other extension which a user can utilize to carry drinking vessel 10.

Container body 200 may be any type of container body. Container body 200 may be generally cylindrical in shape (as shown, for example, in FIGS. 1-3) or have another exterior or interior shape. In some embodiments, container body 200 may be double-walled to enhance thermal insulative properties of container body 200. In some embodiments, an area between beverage container body 200's double walls may be hermetically sealed and may form at least a partial vacuum. In some embodiments, container body 200 may be formed of stainless steel. In some embodiments, container body 200 may be formed of another food-grade material, such as a food-grade plastic (e.g., polypropylene, copolyester, the copolymer sold as Eastman Tritan, high-density polyethylene (HDPE), polyoxymethylene (POM), or acrylonitrile butadiene styrene (ABS)), glass, or another metal (e.g., steel, aluminum, copper, or titanium).

As mentioned, spout 300 may be formed as a separate component from container body 200, or may be formed integrally with container body 200. In embodiments in which spout 300 is formed as a separate component from container body 200, spout 300 may be attachable to container body 200. For example, spout 300 may include an attachment mechanism 330 on a lower side wall 340 of spout 300 and container body 200 may include a corresponding attachment mechanism 230 near an upper edge of container body 200. Attachment mechanism 230 may be configured to engage with attachment mechanism 330 to removably attach spout 300 to container body 200. Attachment mechanisms 330 and 230 may be threaded connectors (as shown in FIG. 4A), friction fit connectors, snap-fit connectors, or any other suitable releasable attachment mechanism. The attachment of spout 300 to container body 200 is not limited to the arrangement shown in the figures. For example, in some embodiments, spout 300 may attach over container body 200 rather than inside container body 200.

The type of attachment mechanism used to attach spout 300 to container body 200 may be of the same or a different type than the attachment mechanism used to attach closure assembly 400 to spout 300. In embodiments in which a threaded connection is used both to attach spout 300 to container body 200 and to attach closure assembly 400 to spout 300, a different number of turns, a different direction or angle of rotation, and/or a different amount of force may be required to operate the two connections. For example, the spout 300 may be more firmly or tightly connected to container body 200 than to closure 400. In this way, closure 400 may be more easily attached and/or detached from spout 300, and spout 300 may be more difficult to detach from container body 200, so that a user turning closure 400 intending to remove closure 400 does not inadvertently remove spout 300 from container body 200.

In some embodiments, spout 300 may include a grip 360. Grip 360 may be or include a high-friction surface. For example, grip 360 may include a three-dimensional pattern (as shown, for example in FIG. 3), include a rough surface, or be formed of a high-friction material. Grip 360 may be accessible to a user when spout 300 is attached to container body 200 and when closure 400 is attached to spout 300. Accordingly, a user may be able to hold spout 300 in place while detaching closure assembly 400 from spout 300 (e.g., by rotating closure assembly 400 in a counterclockwise direction). In this way, spout 300 can remain securely attached to container body 200 even as closure assembly 400 is removed from spout 300.

In some embodiments, spout 300 may include a lip rest 380 on an upper portion of spout 300. Lip rest 380 may allow a user to more comfortably drink from drinking vessel 10 when pouring a beverage from first drinking opening 310 into the user's mouth and/or when sucking the beverage through straw 900 and second drinking opening 320.

Spout 300 may be formed of food-grade plastic (e.g., polypropylene, copolyester, the copolymer sold as Eastman Tritan, high-density polyethylene (HDPE), polyoxymethylene (POM), or acrylonitrile butadiene styrene (ABS)), glass, or metal (e.g., steel, stainless steel, aluminum, copper, or titanium).

FIGS. 6 and 7 show cross-sectional views of drinking vessel 10 when closure 400 is in the sealing position (i.e., when positioning member 700 is in the sealing orientation and protrusion 720 is extended fully into first drinking opening 310). The section in FIG. 6 is taken vertically at the position of line VI-VI' of FIG. 3 (also shown as line VI-VI' in FIG. 7). The section in FIG. 7 is taken horizontally at the position of line VII-VII' of FIG. 3 (also shown as line VII-VII' in FIG. 6).

As shown for example in FIG. 7, a cross section of protrusion 720 may have a shape that corresponds to the shape of a cross section of first drinking opening 310 of spout 300 such that protrusion 720 can extend into first drinking opening 310 of spout 300 in only one orientation. As a result, as can be understood from FIG. 7, protrusion 720 can extended down fully into first drinking opening 310 (into the sealing position) when positioning member 700 is in the sealing orientation; but protrusion 720 cannot extend down fully into first drinking opening 310 in other orientations. For example, if positioning member 700 and protrusion 720 were rotated relative to spout 300 in a counterclockwise direction from the position shown in FIG. 7, protrusion 720 would not fit within first drinking opening 310 with protrusion 720 at the depth shown. Similarly, if positioning member 700 and protrusion 720 were rotated relative to spout 300 in a clockwise direction from the position shown in FIG. 7, protrusion 720 would not fit within first drinking opening 310 with protrusion 720 at the depth shown. In this way, the corresponding cross sectional shapes of protrusion 720 and first drinking opening 310 help ensure that positioning member 700 and protrusion 720 can be fully lowered into first drinking opening 310 when positioning member 700 is in the sealing orientation but not when positioning member 700 is in other orientations.

As shown, for example in FIG. 6, when positioning member 700 is in the sealing orientation, protrusion 720 can extend fully into first drinking opening 310. In this configuration, sealing member 800 may contact or "mate" with upper surface 390 of spout 300. Additionally, in this configuration, threads 640 located on cap 600 may be able to engage with threads 350 located on spout 300 such that sealing member 800 can be compressed between cap 600 and spout 300 by attaching threads 350 to threads 640, thereby sealing first drinking opening 310 and second drinking opening 320. In embodiments in which upper surface 390 of spout 300 is curved or angled, or has another non-planar shape, (as in FIG. 6), orienting sealing member 800 to the sealing orientation ensures that sealing member 800 properly contacts or "mates" with upper surface 390 of spout 300 such that sealing member 800 can seal first drinking opening 310 and second drinking opening 320 when compressed against spout 300. For example, sealing member 800 may have a first sealing portion 830 that is positioned higher than a second sealing portion 840 of sealing member 800, and upper surface 390 of spout 300 has a first portion that is positioned higher than a second portion of spout 300. When sealing member 800 is in a sealing orientation, the first portion of sealing member 800 is positioned above first sealing portion 830 of spout 300, and second sealing portion 840 of sealing member 800 is positioned above the second portion of spout 300. In this way, sealing member 800 properly contacts or "mates" with upper surface 390 of spout 300 when sealing member 800 is in the sealing orientation.

In some embodiments cap 600 may be attachable to spout 300 via a threaded connection, and cap 600 is rotatable relative to positioning member 700 and sealing member 800. Thus, once closure assembly 400 is in the sealing position shown in FIG. 6 (i.e., once positioning member 700 is in the sealing orientation and fully lowered into first drinking opening 310 as shown), threads 640 located on cap 600 may be able to engage with threads 350 located on spout 300. Cap 600 may then be rotated in an engagement direction (e.g., clockwise) to screw threads 640 of cap 600 and threads 350 of the spout 300 together. Because cap 600 is rotatable relative to positioning member 700 and sealing member 800, positioning member 700 and sealing member 800 may remain in the sealing orientation while cap 600 is tightened. Tightening cap 600 may compress sealing member 800 between cap 600 and spout 300, thereby sealing first drinking opening 310 and second drinking opening 320.

Under some circumstances, pressure may build up inside drinking vessel 10, for example when drinking vessel 10 is sealed and used to carry a hot beverage. In some embodiments, sealing member 800 may seal first drinking opening 310 and second drinking opening 320 together (i.e., such that first drinking opening 310 is not sealed independently of second drinking opening 320). This may, for example, allow pressure to equalize between an interior volume of beverage container 100 and an interior volume of straw 900. This avoids or reduces the likelihood of pressure buildup being relieved through straw 900, which could force liquid out through second drinking opening 320 before a user is ready to drink, potentially creating a mess. In some embodiments, for example as shown in FIG. 6, channel 740 provided in protrusion 720 and channel 820 provided in sealing member 800 may at least partially define a fluid pathway between first drinking opening 310 and second drinking opening 320 when closure assembly 400 is attached to beverage container 100. This configuration may similarly, for example, allow pressure to equalize between an interior volume of beverage container 100 and an interior volume of straw 900, thereby avoiding or reducing the likelihood of pressure buildup being relieved through straw 900.

Figure 8:
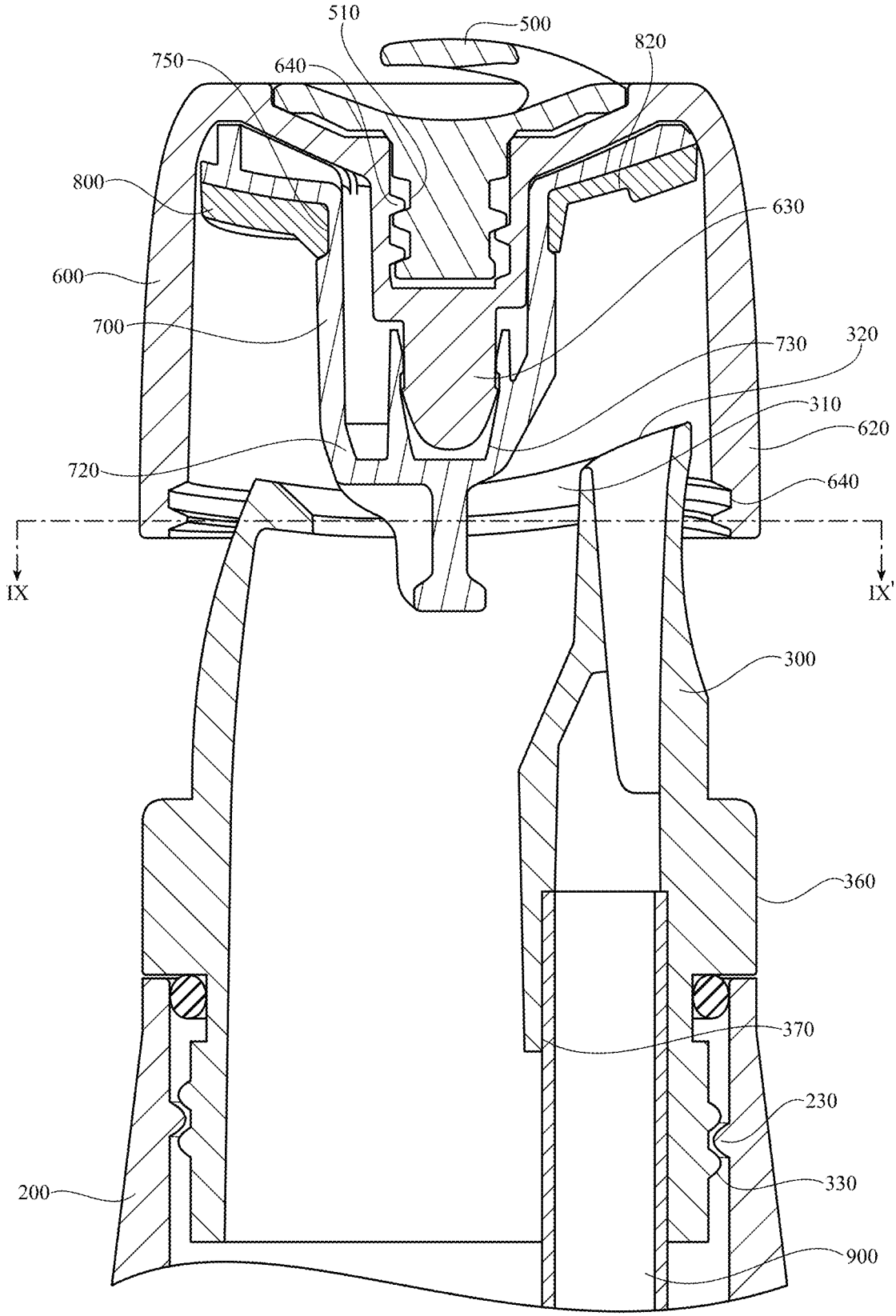
FIG. 8 shows a cross-sectional view of a portion of the drinking vessel of FIG. 1, with its closure assembly in a first position relative to its spout during a closing operation, taken along line VIII-VIII' of FIG. 9.
Figure 9:
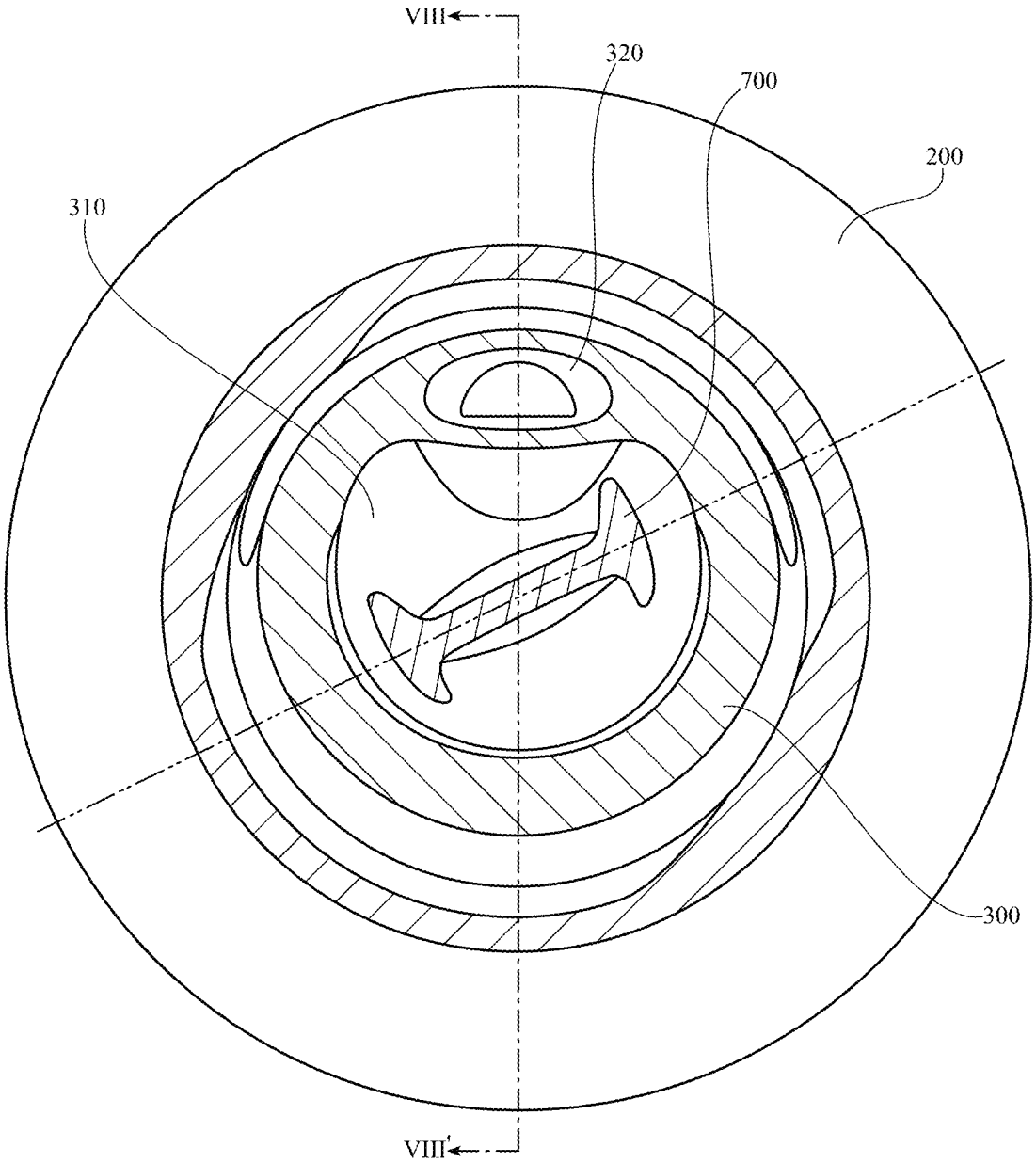
FIG. 9 shows a cross-sectional view of the drinking vessel of FIG. 1, with its closure assembly in a first position relative to its spout during a closing operation, taken along line IX-IX' of FIG. 8.
Figure 12:
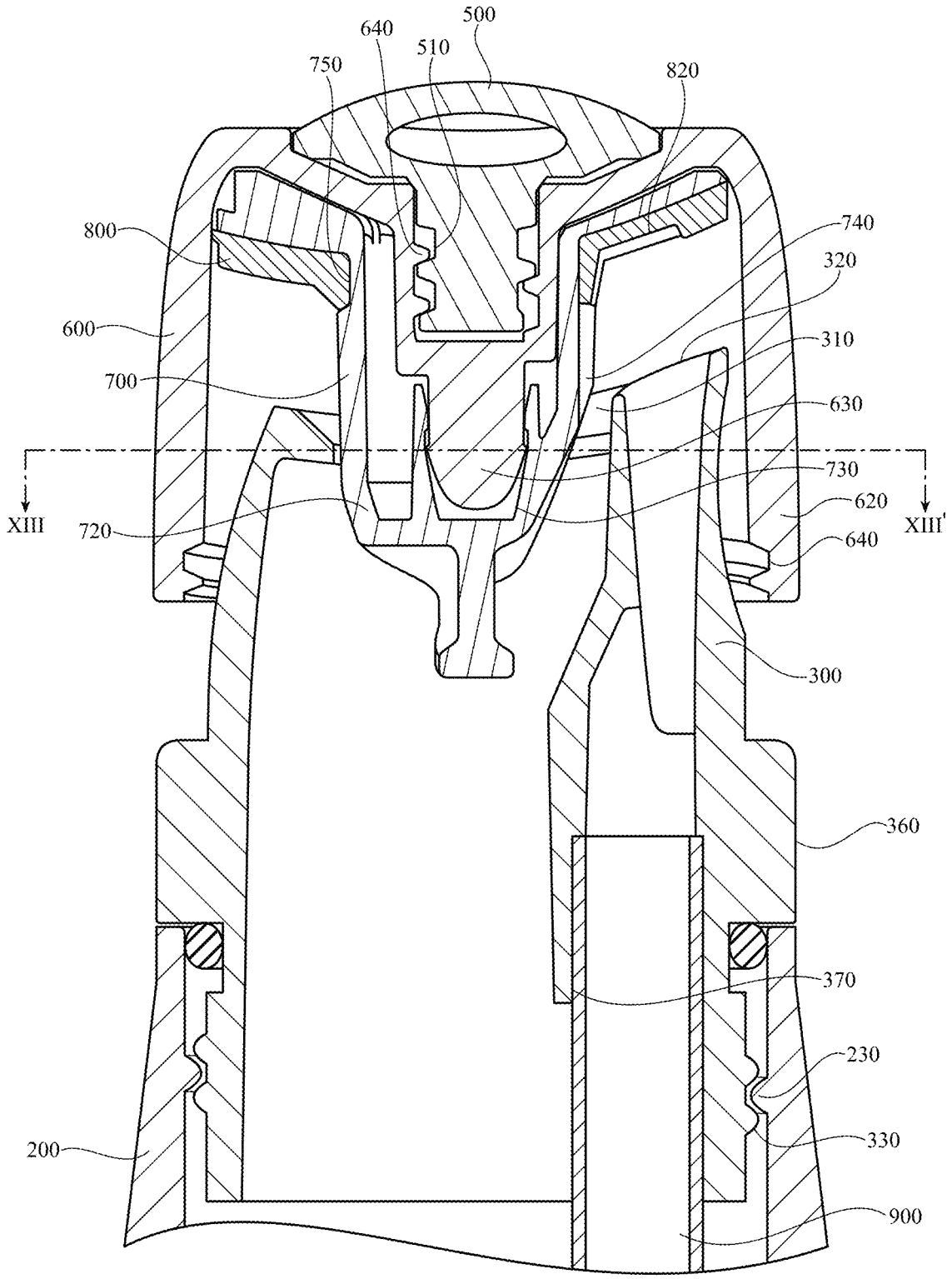
FIG. 12 shows a cross-sectional view of a portion of the drinking vessel of FIG. 1, with its closure assembly in a third position relative to its spout during a closing operation, taken along line XII-XII' of FIG. 13.
Figure 13:
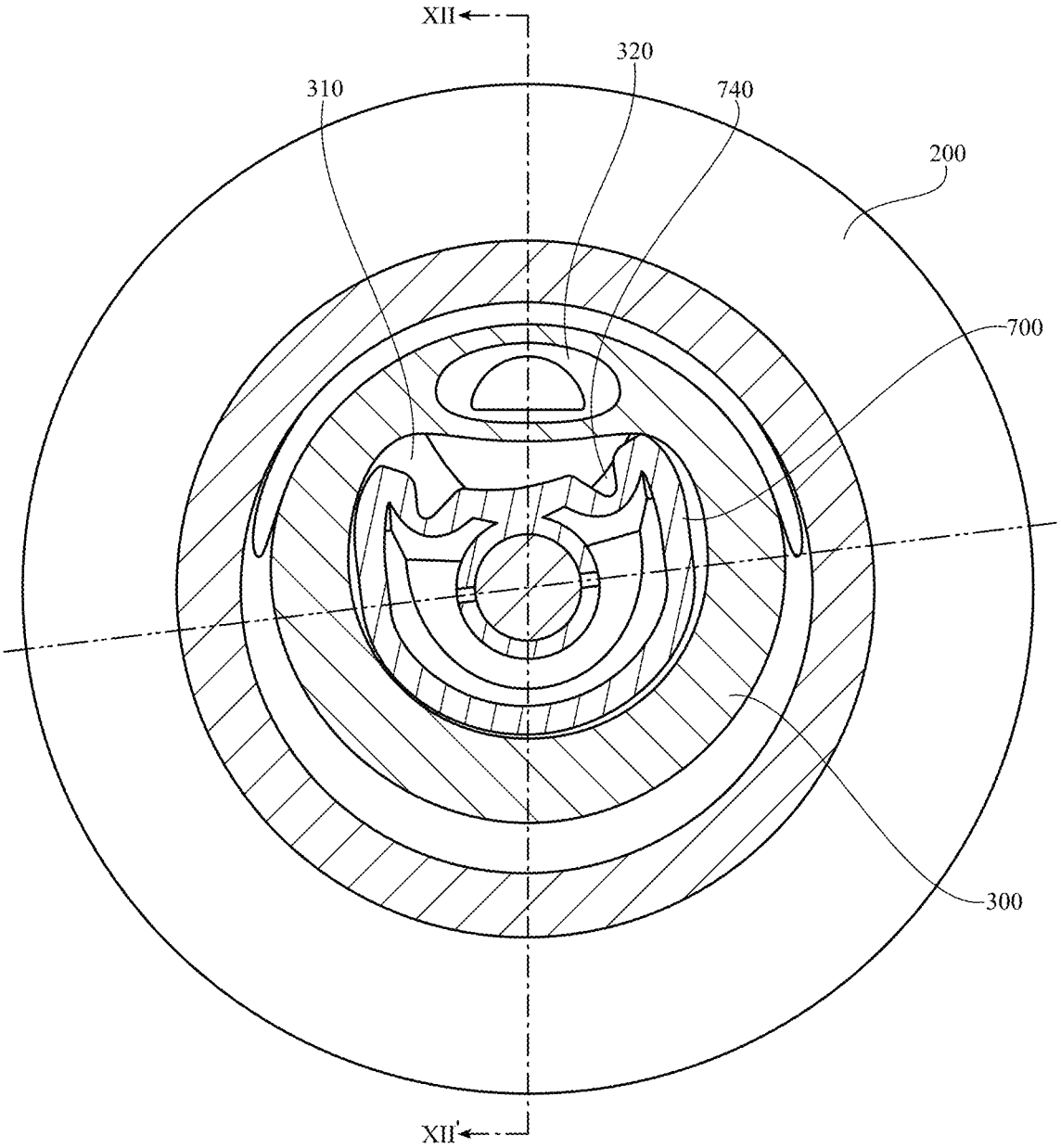
FIG. 13 shows a cross-sectional view of the drinking vessel of FIG. 1, with its closure assembly in a third position relative to its spout during a closing operation, taken along line XIII-XIII' of FIG. 12.

FIGS. 8-15 show an example closing operation, whereby closure assembly 400 is lowered into first drinking opening 310 and rotated in an engagement direction (e.g., clockwise) such that positioning member 700 is rotated to the sealing orientation. The section in FIG. 8 is taken vertically at the position of line VIII-VIII' of FIG. 9. The section in FIG. 9 is taken horizontally at the position of line IX-IX' of FIG. 8. The section in FIG. 10 is taken vertically at the position of line X-X' of FIG. 11. The section in FIG. 11 is taken horizontally at the position of line XI-XI' of FIG. 10. The section in FIG. 12 is taken vertically at the position of line XII-XII' of FIG. 13. The section in FIG. 13 is taken horizontally at the position of line XIII-XIII' of FIG. 12.

FIGS. 8 and 9 show the relative positioning of the positioning member 700 and first drinking opening 310 at the beginning of a closing operation. As shown, a user may not perfectly orient positioning member 700 in the sealing orientation when first lowering closure assembly 400 over spout 300. As can be understood from FIG. 9, protrusion 720 of positioning member 700 cannot be fully lowered into first drinking opening 310 with protrusion 720 in the orientation shown in FIG. 9. This is because as closure assembly 400 is further lowered, a portion of protrusion 720 located above the portion shown in FIG. 9 (e.g., the portion of protrusion 720 shown in FIG. 11) will interfere with an inner surface of first drinking opening 310, thereby preventing protrusion 720 from being further lowered while in the same orientation.

The interference between the inner surface of first drinking opening 310 and protrusion 720 may cause protrusion 720 to rotate toward the sealing orientation. Alternatively or additionally, a user may rotate closure assembly 400 in an engagement direction relative to spout 300 (e.g., going from FIG. 9 to FIG. 11) in order to rotate protrusion 720 toward the sealing orientation. Alternatively or additionally, a user may apply a downward force to closure assembly 400 in order to rotate protrusion 720 toward the sealing orientation. Applying a downward force to closure assembly 400 may cause protrusion 720 to engage with the inner surface of the first drinking opening 310 such that positioning member 700 rotates toward the sealing orientation. As shown in FIGS. 10-15, as positioning member 700 rotates toward the sealing orientation, positioning member 700 can be further lowered into first drinking opening 310.

Figure 14:
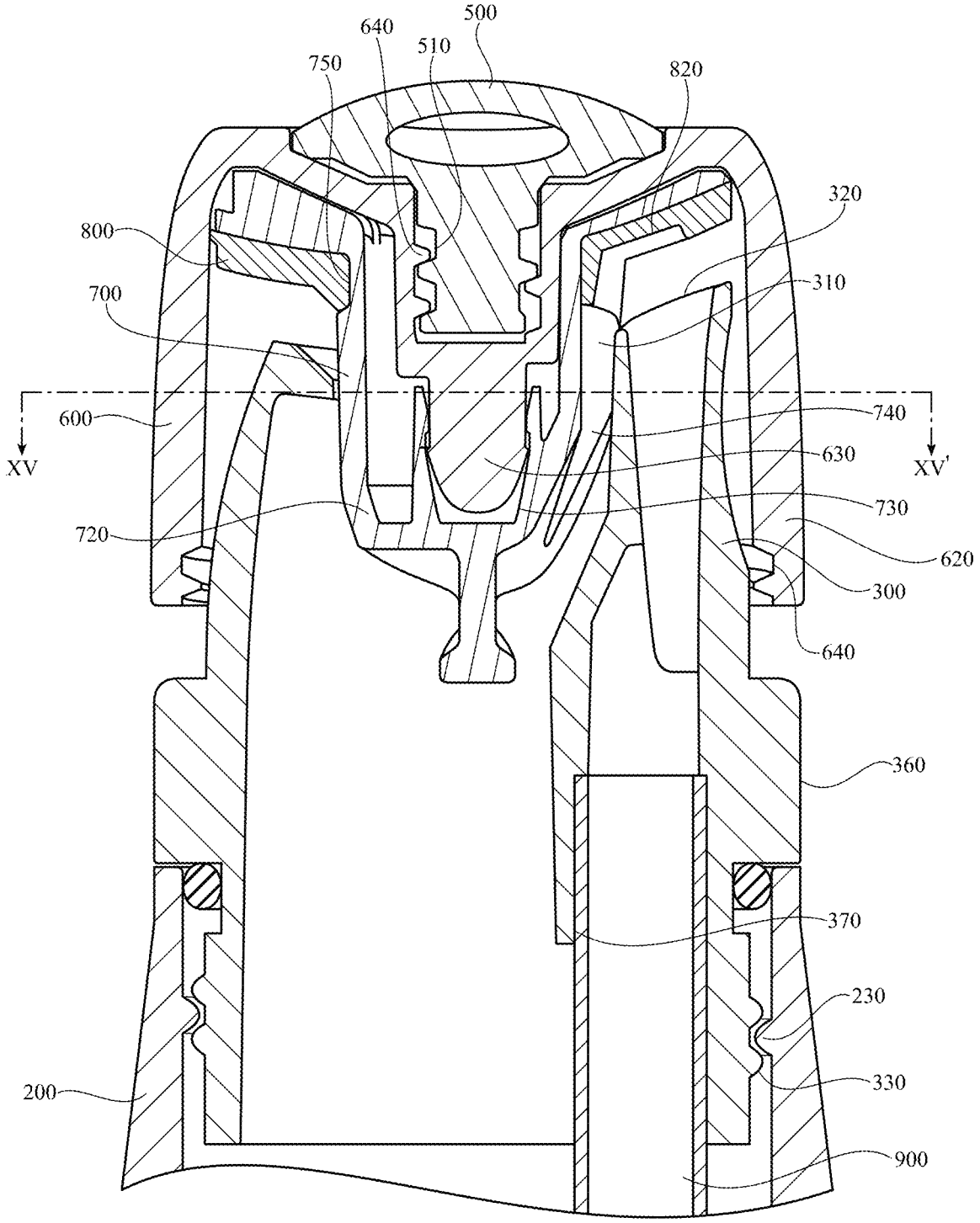
FIG. 14 shows a cross-sectional view of a portion of the drinking vessel of FIG. 1, with its closure assembly in a fourth position relative to its spout during a closing operation, taken along line XIV-XIV' of FIG. 15.
Figure 15:
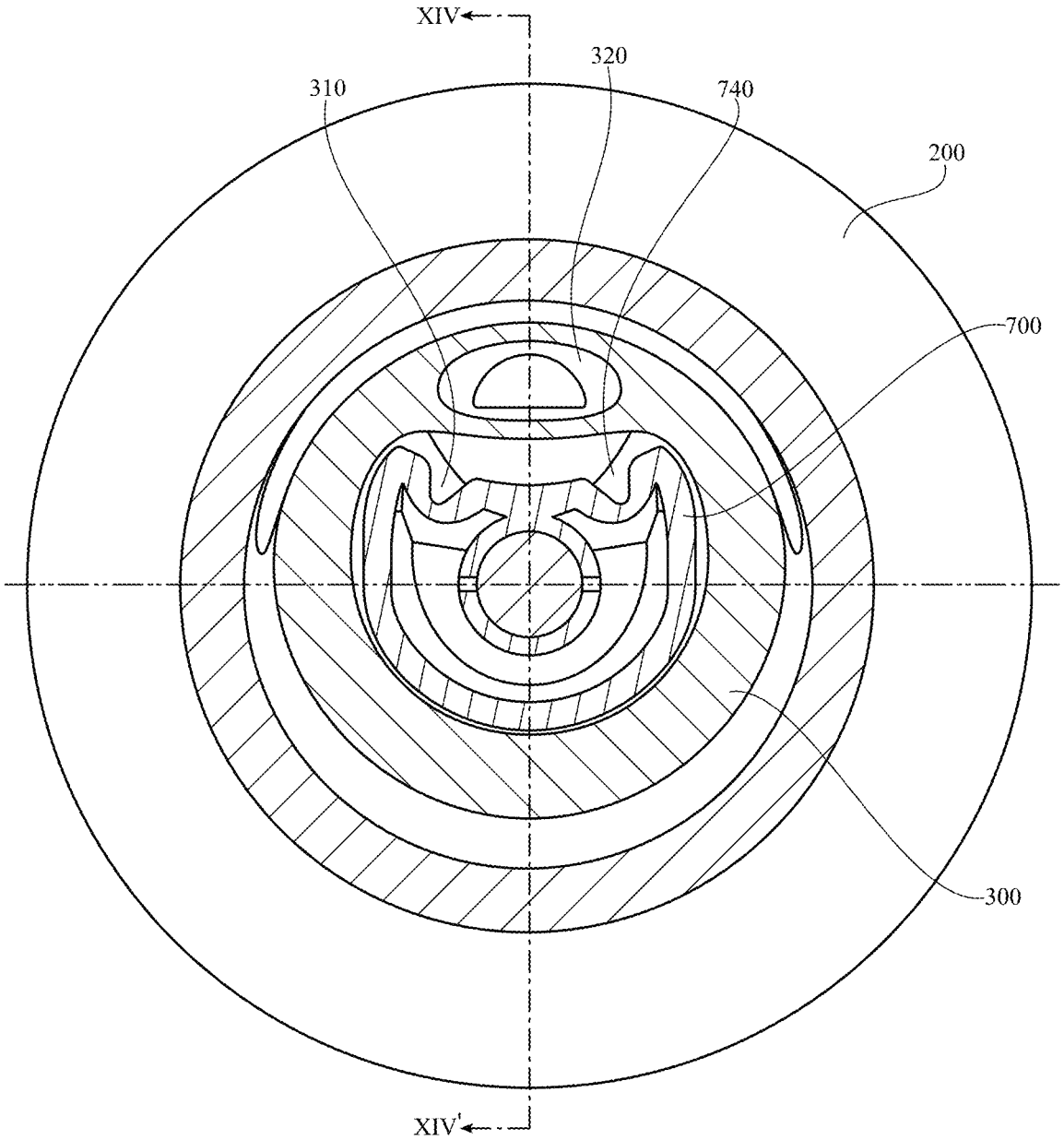
FIG. 15 shows a cross-sectional view of the drinking vessel of FIG. 1, with its closure assembly in a fourth position relative to its spout during a closing operation, taken along line XV-XV' of FIG. 14.

Once positioning member 700 is in the sealing orientation (as shown in FIGS. 14 and 15), positioning member 700 may be stopped from further rotation. For example, an inner surface of first drinking opening 310 may interfere with an outer surface of positioning member 700, thereby inhibiting rotation.

Once positioning member 700 is rotated to the sealing orientation (as shown in FIGS. 14 and 15), positioning member 700 can be fully lowered into first drinking opening 310 of spout 300 and into the sealing position (as shown in FIGS. 6 and 7). As mentioned, once positioning member 700 is in the sealing position, cap 600 may be attached to spout 300. For example, threads 640 located on cap 600 may be able to engage with threads 350 located on spout 300, and cap 600 may be rotated in an engagement direction to screw threads 640 of cap 600 and threads 350 of the spout 300 together. In embodiments in which cap 600 is rotatable relative to positioning member 700 and sealing member 800, positioning member 700 and sealing member 800 may remain in the sealing orientation while cap 600 is tightened. Tightening cap 600 may compress sealing member 800 between cap 600 and spout 300, thereby sealing first drinking opening 310 and second drinking opening 320.

Embodiments have been described above primarily with respect to positioning member 700 and sealing member 800 (e.g., of FIGS. 4A and 5A). It should be understood however that the features, structures, and characteristics discussed herein with respect to positioning member 700 and sealing member 800 can also apply to sealing member 700*b* and positioning member 800*b*, respectively, of FIGS. 4B and 5B, and to combined positioning and sealing member 700*c*/800*c* of FIGS. 4C and 5C. For example, the features, structures, and characteristics discussed with respect to top flange 710 of positioning member 700 can also apply to top flange 710*b* of positioning member 700*b*, and to top flange 710*c* of combined positioning and sealing member 700*c*/800*c*. Similarly, the features, structures, and characteristics discussed with respect to protrusion 720 of positioning member 700 can also apply to protrusion 720*b* of positioning member 700*b*, and to protrusion 720*c* of combined positioning and sealing member 700*c*/800*c*. Similarly, the features, structures, and characteristics discussed with respect to channel 740 of positioning member 700 can also apply to channel 740*b* of positioning member 700*b*, and to channel 740*c* of combined positioning and sealing member 700*c*/800*c*. Similarly, the features, structures, and characteristics discussed with respect to recess 750 of positioning member 700 can also apply to recess 750*b* of positioning member 700*b*. Similarly, the features, structures, and characteristics discussed with respect to receiving opening 810 of sealing member 800 can also apply to receiving opening 810*b* of sealing member 800*b*. Similarly, the features, structures, and characteristics discussed with respect to channel 820 of sealing member 800 can also apply to channel 820*b* of sealing member 800*b*, and to channel 820*c* of combined positioning and sealing member 700*c*/800*c*. Similarly, the features, structures, and characteristics discussed with respect to first sealing portion 830 of sealing member 800 can also apply to first sealing portion 830*b* of sealing member 800*b*, and to first sealing portion 830*c* of combined positioning and sealing member 700*c*/800*c*. Similarly, the features, structures, and characteristics discussed with respect to second sealing portion 840 of sealing member 800 can also apply to second sealing portion 840*b* of sealing member 800*b*, and to second sealing portion 840*c* of combined positioning and sealing member 700*c*/800*c*.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the claims and their equivalents.

What is claimed is:

1. A drinking vessel comprising:

a beverage container having a spout, the spout defining a first drinking opening and a second drinking opening; and a closure assembly attachable to the beverage container, the closure assembly comprising:

a positioning member, the positioning member having a horizontal length that is greater than its horizontal width; and a sealing member, wherein:

when the positioning member is in a sealing orientation, the positioning member can extend deep enough into the first drinking opening for the sealing member to seal the first drinking opening and the second drinking opening, and when the positioning member is not in the sealing orientation, the positioning member cannot extend deep enough into the first drinking opening for the sealing member to seal the first drinking opening and the second drinking opening.

2. The drinking vessel of claim 1, wherein:

the first drinking opening is aligned with a central axis of the spout, and the second drinking opening is offset from the central axis of the spout.

3. The drinking vessel of claim 1, wherein:

the sealing member has a first sealing portion and a second sealing portion, and the first sealing portion of the sealing member is vertically offset from the second sealing portion of the sealing member.

4. The drinking vessel of claim 1, wherein:

the closure assembly further comprises a cap, the cap is attachable to the beverage container via a threaded connection, and the cap is rotatable relative to the positioning member and the sealing member.

5. The drinking vessel of claim 4, wherein when the cap is attached to the beverage container via the threaded connection, the sealing member is compressed between the cap and the spout such that the sealing member seals the first drinking opening and the second drinking opening.

6. The drinking vessel of claim 1, wherein:

the closure assembly further comprises a cap, the cap is attachable to the beverage container via a threaded connection, the threaded connection comprising threads located on the cap and threads located on the beverage container, when the positioning member is in a sealing position, the threads located on the cap can engage with the threads located on the beverage container to compress the sealing member against the spout, and when the positioning member is not in the sealing position, the threads located on the cap cannot engage with the threads located on the beverage container.

7. The drinking vessel of claim 1, wherein:

the closure assembly further comprises a cap, the cap having side walls that extend around the positioning member, the closure assembly is attachable to the beverage container via a threaded connection, the threaded connection comprising threads located on an internal surface of the cap and threads located on an external surface of the beverage container, and when the closure assembly is attached to the beverage container, side walls of the spout are positioned between the side walls of the cap and the positioning member.

8. The drinking vessel of claim 1, wherein when the closure assembly is attached to the beverage container with the positioning member in the sealing orientation, the sealing member seals the first drinking opening and the second drinking opening and at least partially defines a fluid pathway between the first drinking opening and the second drinking opening such that the first drinking opening and the second drinking opening are in fluid communication.

9. The drinking vessel of claim 1, further comprising a straw attachable to the second drinking opening.

10. The drinking vessel of claim 1, wherein the spout and a body of the beverage container are formed as separate pieces.

11. The drinking vessel of claim 10, wherein:

the closure assembly further comprises a cap, the cap is attachable to the spout via a first threaded connection, and the spout is attachable to the body of the beverage container via a second threaded connection.

12. The drinking vessel of claim 11, wherein the spout comprises a grip portion that is accessible to a user when the spout is attached to the body of the beverage container and the cap is attached to the spout.

13. The drinking vessel of claim 1, wherein when the positioning member is in the sealing orientation and extends at least partially into the first drinking opening, an outer surface of the positioning member interferes with an inner surface of the first drinking opening such that the positioning member is inhibited from rotating away from the sealing orientation.

14. The drinking vessel of claim 1, wherein:

the positioning member has a first length-to-width ratio in a first horizontal plane, the positioning member has a second length-to-width ratio in a second horizontal plane located above the first horizontal plane, and the first length-to-width ratio is greater than the second length-to-width ratio.

15. The drinking vessel of claim 1, wherein the positioning member and the sealing member are separate pieces.

16. A drinking vessel comprising:

a beverage container having a spout, the spout defining a first drinking opening and a second drinking opening; and a closure assembly attachable to the beverage container, the closure assembly comprising:

a positioning member;

a sealing member; and a cap, wherein:

when the closure assembly is not in a sealing position, the positioning member, the sealing member, and the cap are rotatable as a unit, when the positioning member is in a sealing orientation, the closure assembly can be lowered into the sealing position, when the closure assembly is in the sealing position, the cap is rotatable relative to the spout while the positioning member and the sealing member remain rotationally stationary relative to the spout, when the closure assembly is in the sealing position, the cap can be attached to the beverage container by rotating the cap so that threads located on the cap engage with threads located on the beverage container, and attaching the cap to the beverage container by engaging the threads located on the cap with the thread located on the beverage container compresses the sealing member between the cap and the spout, thereby sealing the first drinking opening and the second drinking opening.

17. The drinking vessel of claim 16, wherein:

the first drinking opening is aligned with a central axis of the spout, and the second drinking opening is offset from the central axis of the spout.

18. The drinking vessel of claim 16, wherein:

the sealing member has a first sealing portion and a second sealing portion, and the first portion of the sealing member is vertically offset from the second portion of the sealing member.

19. The drinking vessel of claim 16, wherein when the positioning member is in the sealing orientation, an outer surface of the positioning member interferes with an inner surface of the first drinking opening such that the positioning member is inhibited from rotating away from the sealing orientation.

20. The drinking vessel of claim 16, wherein when the closure assembly is attached to the beverage container with the positioning member in the sealing orientation, the sealing member seals the first drinking opening and the second drinking opening and at least partially defines a fluid pathway between the first drinking opening and the second drinking opening such that the first drinking opening and the second drinking opening are in fluid communication.

21. The drinking vessel of claim 16, wherein the positioning member and the sealing member are formed as a unitary piece.

22. A method for sealing a drinking vessel, comprising:

lowering a closure assembly over a spout of a beverage container having a first drinking opening and a second drinking opening, wherein lowering the closure assembly lowers a positioning member of the closure assembly into a positioning aperture of the spout;

rotating the closure assembly in an engagement direction, wherein rotating the closure assembly in the engagement direction causes the positioning member and a sealing member to rotate toward a sealing orientation;

when the positioning member reaches the sealing orientation, further lowering the closure assembly towards the spout so that threads of the closure assembly can engage with threads of the beverage container; and further rotating the closure assembly in the engagement direction while the positioning member and the attached sealing member remain in the sealing orientation, wherein engagement of the threads during the further rotating of the closure assembly causes the sealing member to seal the first drinking opening and the second drinking opening, wherein further lowering of the closure assembly towards the spout is prevented by the positioning member when the positioning member is not in the sealing orientation.

23. The method of claim 22, wherein rotating the closure assembly in the engagement direction causes the positioning member to engage with the positioning aperture such that the positioning member and the attached sealing member rotate toward the sealing orientation.

24. The method of claim 22, wherein further rotating the closure assembly in the engagement direction causes threads located on the closure assembly to engage with threads located on the beverage container.

25. A drinking vessel comprising:

a beverage container having a spout, the spout defining a first drinking opening and a second drinking opening; and a closure assembly attachable to the beverage container, the closure assembly comprising:

a positioning member;

a sealing member; and a cap, the cap having side walls that extend around the positioning member, wherein:

when the positioning member is in a sealing orientation, the positioning member can extend deep enough into the first drinking opening for the sealing member to seal the first drinking opening and the second drinking opening, when the positioning member is not in the sealing orientation, the positioning member cannot extend deep enough into the first drinking opening for the sealing member to seal the first drinking opening and the second drinking opening, the closure assembly is attachable to the beverage container via a threaded connection, the threaded connection comprising threads located on an internal surface of the cap and threads located on an external surface of the beverage container, and when the closure assembly is attached to the beverage container, side walls of the spout are positioned between the side walls of the cap and the positioning member.

* * * * *